US011027331B2

(12) United States Patent
Okada et al.

(10) Patent No.: US 11,027,331 B2
(45) Date of Patent: Jun. 8, 2021

(54) MOLDING FACILITY

(71) Applicant: NIPPON STEEL CORPORATION, Tokyo (JP)

(72) Inventors: Nobuhiro Okada, Tokyo (JP); Shintaro Oga, Tokyo (JP); Yuichi Tsukaguchi, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 16/959,250

(22) PCT Filed: Feb. 25, 2019

(86) PCT No.: PCT/JP2019/007146
§ 371 (c)(1),
(2) Date: Jun. 30, 2020

(87) PCT Pub. No.: WO2019/164004
PCT Pub. Date: Aug. 29, 2019

(65) Prior Publication Data

US 2020/0331057 A1 Oct. 22, 2020

(30) Foreign Application Priority Data

Feb. 26, 2018 (JP) ..... JP2018-031995

(51) Int. Cl.
*B22D 11/115* (2006.01)
*B22D 11/041* (2006.01)
*B22D 11/055* (2006.01)

(52) U.S. Cl.
CPC ..... *B22D 11/115* (2013.01); *B22D 11/041* (2013.01); *B22D 11/055* (2013.01)

(58) Field of Classification Search
CPC ... B22D 11/115; B22D 11/122; B22D 11/205; B22D 11/041; B22D 11/055
See application file for complete search history.

(56) References Cited

FOREIGN PATENT DOCUMENTS

| | | | |
|---|---|---|---|
| JP | 6-226409 | A | 8/1994 |
| JP | 2000-61599 | A | 2/2000 |
| JP | 2002-45953 | A | 2/2002 |
| JP | 2015-27687 | A | 2/2015 |

*Primary Examiner* — Kevin P Kerns
*Assistant Examiner* — Steven S Ha
(74) *Attorney, Agent, or Firm* — Birch, Stewart, Kolasch & Birch, LLP

(57) ABSTRACT

A molding facility in continuous casting enabling the quality of the cast slab to be achieved stably even if improving the productivity, the molding facility provided with a mold for continuous casting use, a first water box and second water box storing cooling water for cooling the mold, an electromagnetic stirring device imparting to molten metal in the mold an electromagnetic force causing a swirling flow to be generated in a horizontal plane, and an electromagnetic brake device imparting to a discharge flow of molten metal to an inside of the mold from a submerged nozzle an electromagnetic force in a direction braking the discharge flow, the first water box, the electromagnetic stirring device, the electromagnetic brake device, and the second water box being placed in that order from above to below at an outside surface of a long side mold plate of the mold so as to fit between a top end and bottom end of the long side mold plate, a core height H1 of the electromagnetic stirring device and a core height H2 of the electromagnetic brake device satisfying 0.80≤H1/H2≤2.33.

8 Claims, 8 Drawing Sheets

MOLDING FACILITY

FIELD

The present invention relates to a molding facility provided with a mold used in continuous casting and an electromagnetic force generating device imparting electromagnetic force to molten metal in that mold.

BACKGROUND

In continuous casting, molten metal stored once in a tundish (for example, molten steel) is poured through a submerged nozzle into a mold from above. There, the outer circumferential surface is cooled and the solidified cast slab is pulled out from the bottom end of the mold whereby the metal is continuously cast. In the cast slab, the solidified part at the outer circumferential surface is called the "solidified shell".

Here, the molten metal contains bubbles of inert gas (for example, Ar gas) supplied together with the molten metal so as to prevent clogging of the discharge holes of the submerged nozzle, contains nonmetallic inclusions, etc. If these impurities remain in the cast slab after casting, they will cause the quality of the finished product to deteriorate. In general, the specific gravity of these impurities is smaller than that of the molten metal. Thus, they are often removed upon floating up in the molten metal during continuous casting. Therefore, if making the casting speed increase, these impurities no longer sufficiently float up and are separated and the quality of the cast slab tends to fall. In this way, in continuous casting, there is a tradeoff between the productivity and the quality of the cast slab, that is, in this relation, if pursuing productivity, the quality of the cast slab deteriorates while if giving priority to the quality of the cast slab, the productivity falls.

In recent years, the quality sought for some products such as external panels for automobiles has been becoming increasingly tough. Therefore, in continuous casting, to achieve quality, productivity has tended to be sacrificed in operations. In view of such a situation, in continuous casting, art for securing the quality of the cast slab while further improving productivity has been sought.

On the other hand, it is known that the quality of the cast slab is greatly affected by the flow motion of the molten metal in the mold at the time of continuous casting. Therefore, it is possible that by suitably controlling the flow motion of the molten metal in the mold, the desired quality of the cast slab can be maintained while realizing high speed, stable operation, that is, improving the productivity.

To control the flow motion of the molten metal in the mold, art is being developed for use of an electromagnetic force generating device imparting electromagnetic force to the molten metal in the mold. Note that, in this Description, the group of members around a mold, including the mold and electromagnetic force generating device, will be referred to for convenience as a "molding facility".

Specifically, as an electromagnetic force generating device, an electromagnetic brake device and electromagnetic stirring device are being widely used. Here, an "electromagnetic brake device" is a device applying a stationary magnetic field to the molten metal to thereby cause the generation of a braking force inside the molten metal and suppress flow motion of the molten metal. On the other hand, an "electromagnetic stirring device" is an device applying a moving magnetic field to molten metal to thereby cause the generation of an electromagnetic force called a "Lorentz force" in the molten metal and impart to the molten metal a pattern of flow motion making it swirl in the horizontal plane of the mold.

An electromagnetic brake device is generally provided so as to cause the generation in the molten metal of a braking force weakening the strength of the discharge flow ejected from the submerged nozzle. Here, the discharge flow from the submerged nozzle strikes the inside walls of the mold to thereby form an ascending flow heading in the upper direction (that is, direction where surface of molten metal is present) and a descending flow heading in the lower direction (that is, direction in which the cast slab is pulled out). Therefore, by the strength of the discharge flow being weakened by the electromagnetic brake device, the strength of the ascending flow is weakened and the fluctuation of the melt surface of the molten metal can be suppressed. Further, the strength of the discharge flow striking the solidified shell is also weakened, so the effect of suppressing breakout due to remelting of the solidified shell can be obtained. In this way, an electromagnetic brake device is used in the case of aiming at high speed, stable casting. Further, due to the electromagnetic brake device, the flow rate of the descending flow formed by the discharge flow is suppressed, so floating and separation of impurities in the molten metal are promoted and the effect of improving the internal quality of the cast slab (below, also referred to as the "inside quality") can also be obtained.

On the other hand, as a shortcoming of an electromagnetic brake device, mention may be made of the fact that the flow rate of molten metal at the interface with the solidified shell becomes lower, so sometimes the surface quality deteriorates. Further, it becomes harder for the ascending flow formed by the discharge flow to reach the melt surface, so due to the drop in melt surface temperature, skinning occurs and flaws are liable to be caused in the inside quality.

An electromagnetic stirring device, as explained above, imparts a predetermined pattern of flow motion to the molten metal, that is, causes generation of a stirring flow inside the molten metal. Due to this, flow motion of the molten metal at the interface with the solidified shell is promoted, so the above-mentioned Ar gas bubbles or nonmetallic inclusions or other impurities are kept from being trapped inside the solidified shell and the surface quality of the cast slab can be improved. On the other hand, as a shortcoming of an electromagnetic stirring device, due to the stirring flow striking the inside wall of the mold, in the same way as the discharge flow from the above-mentioned submerged nozzle, an ascending flow and a descending flow are generated, so sometimes the inside quality of the cast slab will be lowered by the ascending flow capturing powder at the melt surface and the descending flow carrying impurities downward at the mold.

As explained above, an electromagnetic brake device and electromagnetic stirring device have respective good points and bad points from the viewpoint of securing the quality of the cast slab. Therefore, for the purpose of improving both the surface quality and inside quality of the cast slab, art is being developed for continuous casting using a molding facility provided with both an electromagnetic brake device and electromagnetic stirring device at the mold or a molding facility provided with a plurality of electromagnetic stirring devices at the mold.

For example, PTL 1 discloses a molding facility provided with an electromagnetic stirring device above the mold (more particularly, near the meniscus) and provided with an electromagnetic brake device below the mold. PTL 1 describes that, due to this constitution, the effect is obtained that the surface quality of the cast slab can be improved by the electromagnetic stirring device and entrance of inclusions into the cast slab which can remarkably occur when performing high speed casting can be reduced by the electromagnetic brake device (that is, the inside quality can be improved). Further, for example, PTL 2 discloses a molding facility provided with two stages of electromagnetic stirring devices in the vertical direction. PTL 2 describes that by such a constitution, the effect can be obtained that the surface quality of the cast slab can be improved by the top stage electromagnetic stirring device causing electromagnetic force to act on the molten metal near the meniscus and that the inside quality of the cast slab can be improved by the bottom stage electromagnetic stirring device causing electromagnetic force to act on the discharge flow from the submerged nozzle.

Further, PTL 3 describes a continuous casting device with an electromagnetic stirring device EMS placed above the mold and with an electromagnetic brake device LMF placed so that the top end of the core becomes a position of a predetermined distance from the top part of the mold. Further, PTL 4 relates to a continuous casting method for steel and describes a configuration using an electromagnetic stirring coil and electromagnetic brake device.

CITATIONS LIST

Patent Literature

[PTL 1] Japanese Unexamined Patent Publication No. 6-226409

[PTL 2] Japanese Unexamined Patent Publication No. 2000-61599

[PTL 3] Japanese Unexamined Patent Publication No. 2015-27687

[PTL 4] Japanese Unexamined Patent Publication No. 2002-45953

SUMMARY

Technical Problem

However, in the molding facility disclosed in PTL 1, the bottom end of the electromagnetic brake device is positioned below the mold. The electromagnetic force (braking force) generated by the electromagnetic brake acts in accordance with the flow rate of the molten metal, so with such a set position, it is feared that the electromagnetic force acting on the molten metal will become extremely small compared with the case of setting the electromagnetic brake device near the discharge holes of the submerged nozzle. That is, the effect of improvement of the inside quality of the cast slab by the electromagnetic brake device at the time of high speed casting described in PTL 1 may be limited. Regarding this point, the inventors ran simulations by numerical analysis for study assuming general casting conditions (size of cast slab and type of product, position of submerged nozzle, etc.) As a result, they newly learned that in the case of setting the electromagnetic brake device at the position described in PTL 1, if making the casting speed increase to improve the productivity, the problem may arise that to be able to suitably prevent entry of inclusions, the casting speed must be no more than 1.6 m/min or so and that if the casting speed exceeds 1.6 m/min or so, it is difficult to effectively prevent the entry of inclusions.

Further, in the molding facility disclosed in PTL 2, no electromagnetic brake device is used. The electromagnetic stirring device is used to create an upward force acting on the discharge flow so as to reduce the strength of the discharge flow. However, the electromagnetic force generated due to electromagnetic stirring acts without regard as to fluctuations in the flow rate of the discharge flow, so it is believed difficult to use the electromagnetic stirring device to stably control the flow rate of the discharge flow. The inventors studied this and as a result newly learned that the problem may arise that if trying to use the molding facility described in PTL 2 to control the flow motion of molten metal inside the mold, due to the above-mentioned difficulty in control of the discharge flow by the electromagnetic stirring device, the flow motion of the molten metal easily becomes unstable and the inside quality of the cast slab will easily fluctuate.

Further, the arts described in PTL 3 and PTL 4 all had casting speeds of low speeds of 1.5 m/min or less and did not envision high speed casting.

There is still room for study regarding the suitable configuration of an electromagnetic force generating device able to achieve the quality of the cast slab while improving the productivity. Therefore, the present invention was made in consideration of the above problem. The present invention has as its object the provision of a new and improved molding facility able to stably achieve the quality of the cast slab even in a case of improving the productivity in continuous casting.

Solution to Problem

The inventors tried using a molding facility combining an electromagnetic brake device and an electromagnetic stirring device in continuous casting to stabilize the flow motion of molten metal inside the mold so as to achieve the quality of the cast slab while improving the productivity. However, these devices were not ones where the good points of the two devices could be simply obtained by just installing the two devices. For example, as will be understood from the effect on the flow rate of molten metal at the interface of the solidified shell explained above, these devices have aspects acting to cancel out each other's effects. Therefore, in continuous casting using both an electromagnetic brake device and electromagnetic stirring device, quite often the quality of the cast slab (surface quality and inside quality) will end up deteriorating compared with the case of using these devices respectively alone.

Therefore, the inventors ran repeated simulations by numerical analysis and actual machine tests and engaged in in-depth studies. As a result, they discovered that in continuous casting using an electromagnetic brake device and electromagnetic stirring device, to more effectively draw out the effect of improvement of the quality of the cast slab and enable the quality of the cast slab to be achieved even when improving the productivity, it is important to suitable define the configurations and positions of placement of these devices.

That is, to solve the above technical problem, according to one aspect of the present invention, there is provided a molding facility comprising a mold for continuous casting use, a first water box and second water box storing cooling water for cooling the mold, an electromagnetic stirring device imparting to molten metal in the mold an electromagnetic force causing a swirling flow to be generated in a horizontal plane, and an electromagnetic brake device imparting an electromagnetic force to a discharge flow of molten metal to an inside of the mold from a submerged nozzle in a direction braking the discharge flow, the first water box, the electromagnetic stirring device, the electromagnetic brake device, and the second water box being placed in that order from above to below at an outside surface of a long side mold plate of the mold, a core height H1 of the electromagnetic stirring device and a core height H2 of the electromagnetic brake device satisfying a relationship shown in the following numerical formula (101): Here, the casting speed may be 2.0 m/min or less.

[Mathematical 1]

$$0.80 \leq \frac{H1}{H2} \leq 2.33 \quad (101)$$

Further, in the molding facility, the core height H1 of the electromagnetic stirring device and the core height H2 of the electromagnetic brake device may satisfy the relationship shown in the following numerical formula (103): Here, the casting speed may be 2.2 m/min or less.

[Mathematical 2]

$$1.00 \leq \frac{H1}{H2} \leq 2.00 \quad (103)$$

Further, the core height H1 of the electromagnetic stirring device and the core height H2 of the electromagnetic brake device may satisfy the relationship shown in the following numerical formula (105): Here, the casting speed may be 2.4 m/min or less.

[Mathematical 3]

$$1.00 \leq \frac{H1}{H2} \leq 1.5 \quad (105)$$

Further, the core height H1 of the electromagnetic stirring device and the core height H2 of the electromagnetic brake device may satisfy the relationship shown in the following numerical formula (2):

[Mathematical 4]

$$H1+H2 \leq 500 \text{ mm} \quad (2)$$

Further, the electromagnetic brake device may be comprised of a split brake.

Advantageous Effects of Invention

As explained above, according to the present invention, it becomes possible to achieve the quality of the cast slab in continuous casting even if improving the productivity.

DESCRIPTION OF EMBODIMENTS

Figure 1:
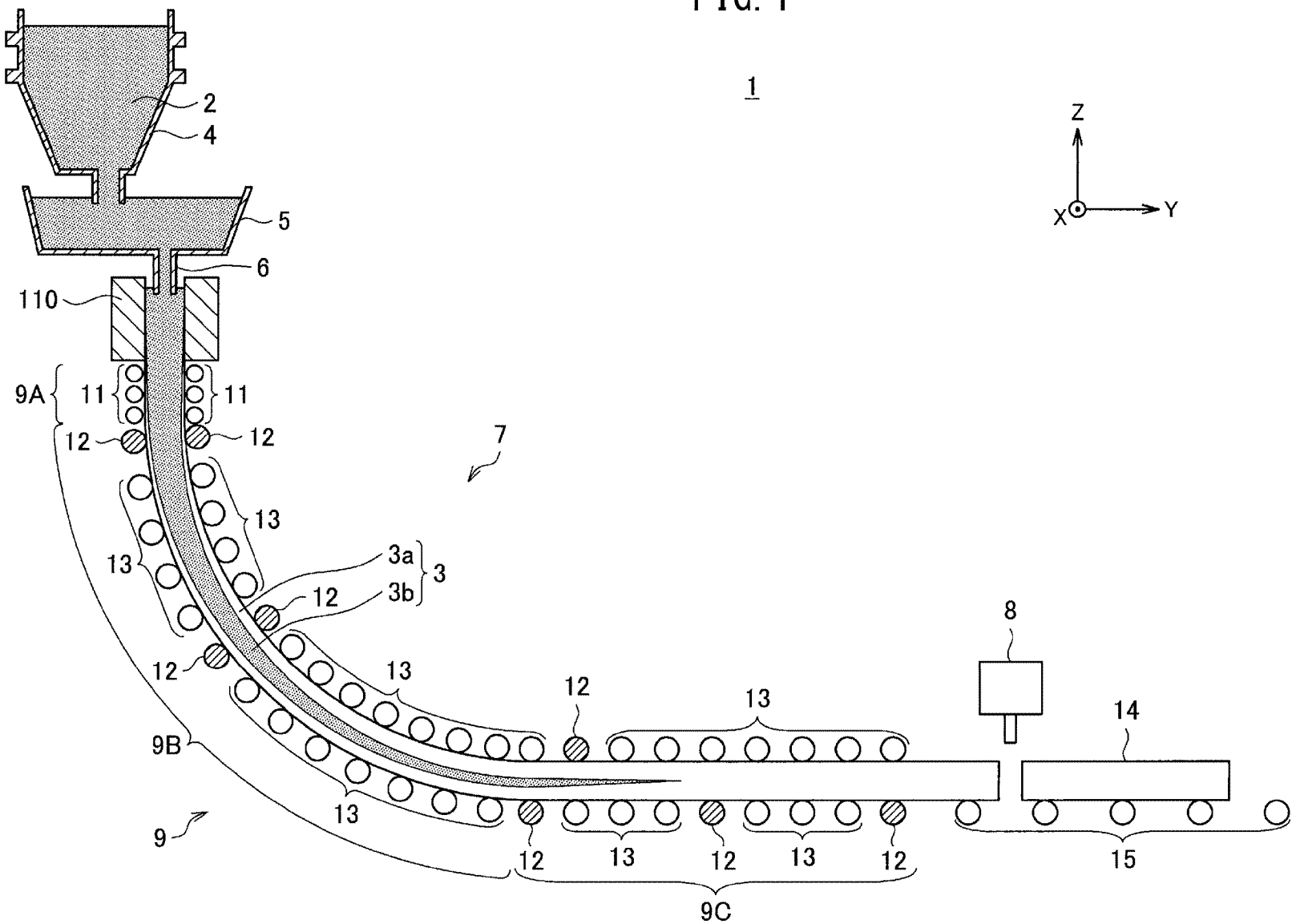
FIG. 1 is a side cross-sectional view schematically showing one example of the configuration of a continuous casting machine according to the present embodiment.

Below, while referring to the attached drawings, preferred embodiments of the present invention will be explained in detail. Note that, in the Description and drawings, component elements having substantially the same functions and configurations will be assigned the same reference notations and overlapping explanations will be omitted.

Note that, in the drawings shown in the Description, for explanation, sometimes some of the component elements will be represented exaggerated in size. The relative sizes of the members illustrated in the drawings do not necessarily accurately represent the relative sizes of the actual members.

Further, below, as one example, embodiments where the molten metal is molten steel will be explained. However, the present invention is not limited to such examples. The present invention may be applied to continuous casting of other metals as well.

1. Configuration of Continuous Casting Machine

Referring to FIG. 1, the configuration of a continuous casting machine according to one preferred embodiment of the present invention and a continuous casting method will be explained. FIG. 1 is a side cross-sectional view schematically showing one example of the constitution of the continuous casting machine according to the present embodiment.

As shown in FIG. 1, the continuous casting machine 1 according to the present embodiment is an apparatus using a mold 110 for continuous casting use to continuously cast molten steel 2 and produce a steel slab or other cast slab 3. The continuous casting machine 1 is provided with a mold 110, a ladle 4, a tundish 5, a, submerged nozzle 6, a secondary cooling device 7, and a cast slab cutter 8.

The ladle 4 is a movable vessel for conveying molten steel 2 from the outside to the tundish 5. The ladle 4 is arranged above the tundish 5. Molten steel 2 inside the ladle 4 is supplied to the tundish 5. The tundish 5 is arranged above the mold 110, stores molten steel 2, and removes inclusions in the molten steel 2. The submerged nozzle 6 extends from the bottom end of the tundish 5 downward toward the mold 110. The front end of the submerged nozzle 6 is submerged in the molten steel 2 in the mold 110. The submerged nozzle 6 continuously supplies molten steel 2 from which inclusions were removed in the tundish 5 to the inside of the mold 110.

The mold 110 is a rectangular cylindrical shape designed for the width and thickness of the cast slab 3. For example, it is assembled so that a pair of long side mold plates (corresponding to long side mold plates 111 shown in FIG. 2 explained later) sandwich a pair of short side mold plates (corresponding to short side mold plates 112 shown in FIG. 4 to FIG. 6 explained later) from the two sides. The long side mold plates and short side mold plates (below, sometimes referred to all together as the "mold plates"), for example, are water-cooled copper plates at which channels are provided for flow of cooling water. The mold 110 cools the molten steel 2 contacting the mold plates to produce a cast slab 3. The cast slab 3 moves toward the bottom through the mold 110. Along with this, the inside unsolidified part 3*b* proceeds to be solidified whereby the outside solidified shell 3*a* gradually becomes greater in thickness. The cast slab 3 including the solidified shell 3*a* and the unsolidified part 3*b* is pulled out from the bottom end of the mold 110.

Note that, in the following explanation, the up-down direction (that is, the direction in which the cast slab 3 is pulled out from the mold 110) will also be called the "Z-axis direction". Further, the two directions perpendicular to each other in the plane vertical to the Z-axis direction (horizontal plane) will also be called the "X-axis direction" and "Y-axis direction". Further, the X-axis direction is defined as the direction parallel to the long sides of the mold 110 in the horizontal plane while the Y-axis direction is defined as the direction parallel to the short sides of the mold 110 in the horizontal plane. Further, in the following explanation, when expressing the sizes of the members, sometimes the length of a member in the Z-axis direction will be referred to as the "height" while the length of that member in the X-axis direction or Y-axis direction will be referred to as the "width".

Here, in FIG. 1, while illustration is omitted for avoiding complication of the drawing, in the present embodiment, an electromagnetic force generating device is set at the outside surface of a long side mold plate of the mold 110. The electromagnetic force generating device is provided with an electromagnetic stirring device and electromagnetic brake device. In the present embodiment, by driving the electromagnetic force generating device while performing continuous casting, it becomes possible to achieve the quality of the cast slab while performing casting by a higher speed. The configuration of the electromagnetic force generating device and the position of placement with respect to the mold 110 etc. will be explained later with reference to FIG. 2 to FIG. 5.

The secondary cooling device 7 is provided at a secondary cooling zone 9 below the mold 110 and supports and conveys the cast slab 3 pulled out from the bottom end of the mold 110 while cooling it. This secondary cooling device 7 has a plurality of pairs of support rolls (for example, support rolls 11, pinch rolls 12, and segment rolls 13) arranged at the both sides of the cast slab 3 in the thickness direction and a plurality of spray nozzles (not shown) spraying the cast slab 3 with cooling water.

The support rolls provided at the secondary cooling device 7 are arranged in pairs at the both sides of the cast slab 3 in the thickness direction and function as supporting and conveying means for supporting the cast slab 3 while conveying it. By using the support rolls to support the cast slab 3 from the both sides in the thickness direction, it is possible to prevent breakout and bulging of the cast slab 3 during solidification at the secondary cooling zone 9.

The support rolls comprised of the support rolls 11, pinch rolls 12, and segment rolls 13 form a conveyance path (pass line) of the cast slab 3 in the secondary cooling zone 9. This pass line, as shown in FIG. 1, is vertical directly below the mold 110 and then bends to a curved shape and finally becomes horizontal. In the secondary cooling zone 9, the part where the pass line is vertical will be referred to as the "vertical part 9A", the part where it bends will be referred to as the "curved part 9B", and the part where it is horizontal will be referred to as the "horizontal part 9C". A continuous casting machine 1 which has such a pass line is called a "vertical-curved type continuous casting machine 1". Note that, the present invention is not limited to the vertical-curved type continuous casting machine 1 such as shown in FIG. 1. It can also be applied to a curved type or vertical type or other various types of continuous casting machines.

The support rolls 11 are undriven type rolls provided at the vertical part 9A right below the mold 110 and support the cast slab 3 right after being pulled out from the mold 110. The cast slab 3 right after being pulled out from the mold 110 is in a state with a thin solidified shell 3*a*, so has to be supported at relatively short intervals (roll pitch) to prevent breakout or bulging. For this reason, as the support rolls 11, small diameter rolls enabling reduction of the roll pitch are preferably used. In the example shown in FIG. 1, three pairs of support rolls 11 comprised of small diameter rolls are provided at a relatively narrow roll pitch at the both sides of the cast slab 3 at the vertical part 9A.

The pinch rolls 12 are driven type rolls rotating by motors or other driving means and have the function of pulling out the cast slab 3 from the mold 110. The pinch rolls 12 are arranged at suitable positions at the vertical part 9A, curved part 9B, and horizontal part 9C respectively. The cast slab 3 is pulled out from the mold 110 by the force transmitted from the pinch rolls 12 and is conveyed along the pass line. Note that, the arrangement of the pinch rolls 12 is not limited to the example shown in FIG. 1. The positions of arrangement may be freely set.

The segment rolls 13 (also called "guide rolls") are undriven type rolls provided at the curved part 9B and horizontal part 9C and support and guide the cast slab 3 along the pass line. The segment rolls 13 may be provided with respectively different roll sizes or roll pitches depending on the positions on the pass line and depending on which of the F surface (fixed surface, surface at bottom left side in FIG. 1) of the cast slab 3 or L surface (loose surface, surface at top right in FIG. 1) they are set at.

The cast slab cutter 8 is arranged at the terminal end of the horizontal part 9C of the pass line and cuts the cast slab 3 conveyed along the pass line into predetermined lengths. The cut thick plate shaped cast slab 14 is conveyed to the facility at the next step by table rolls 15.

Above, referring to FIG. 1, the overall configuration of the continuous casting machine 1 according to the present embodiment is explained. Note that, in the present embodiment, the above-mentioned electromagnetic force generating device is set at the mold 110. That electromagnetic force generating device may be used to perform the continuous casting. The configuration at the continuous casting machine 1 other than the electromagnetic force generating device may be similar to that of a general conventional continuous casting machine. Therefore, the configuration of the continuous casting machine 1 is not limited to the one illustrated. As the continuous casting machine 1, ones of all sorts of configuration may be used.

2. Electromagnetic Force Generating Device 2-1. Configuration of Electromagnetic Force Generating Device Referring to FIG. 2 to FIG. 5, the configuration of an electromagnetic force generating device provided at the above-mentioned mold 110 will be explained in detail. FIG. 2 to FIG. 5 are views showing one example of the configuration of the molding facility according to the present embodiment.

Figure 2:
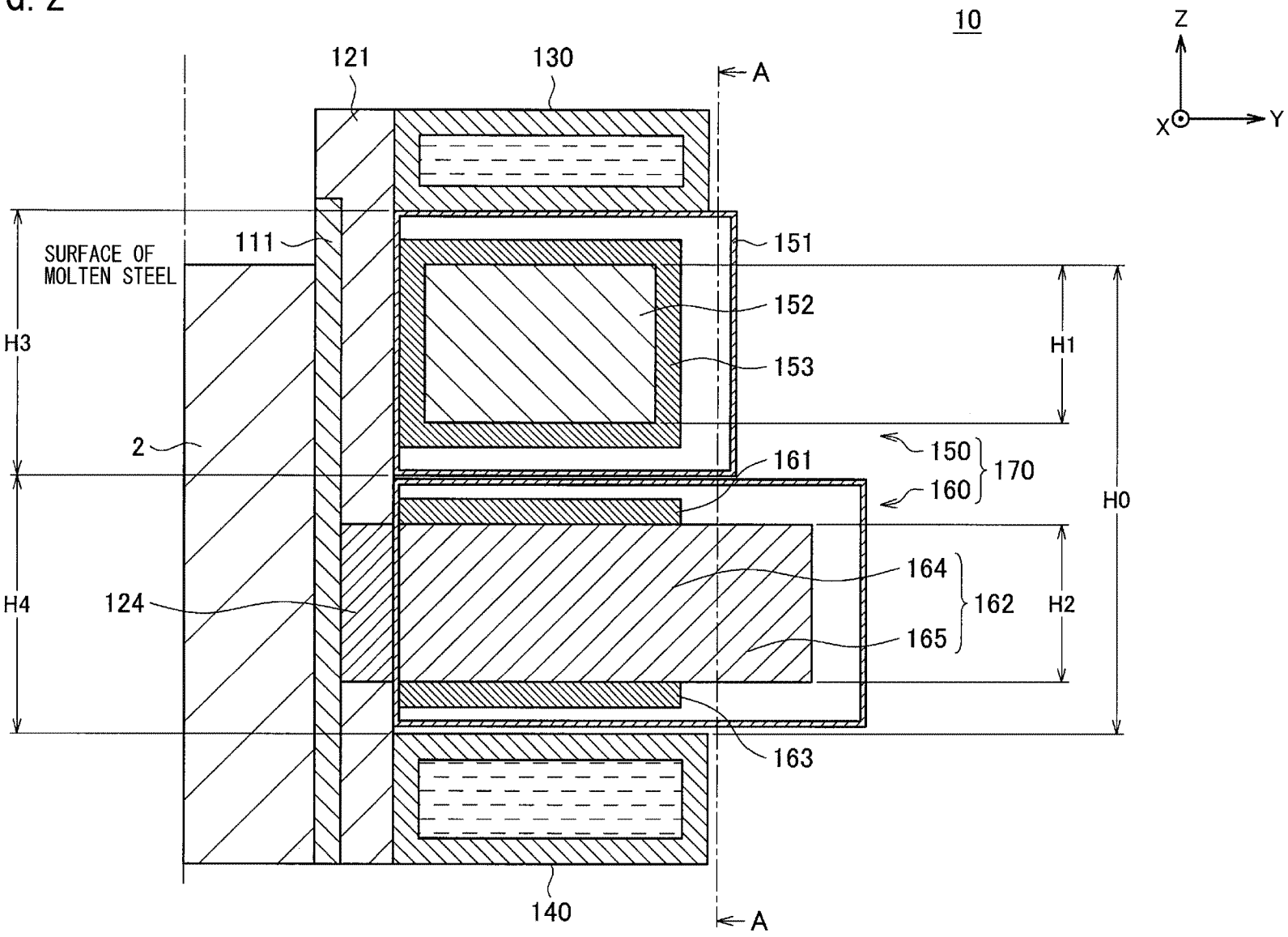
FIG. 2 is a cross-sectional view along a Y-Z plane of a molding facility according to the present embodiment.
Figure 3:
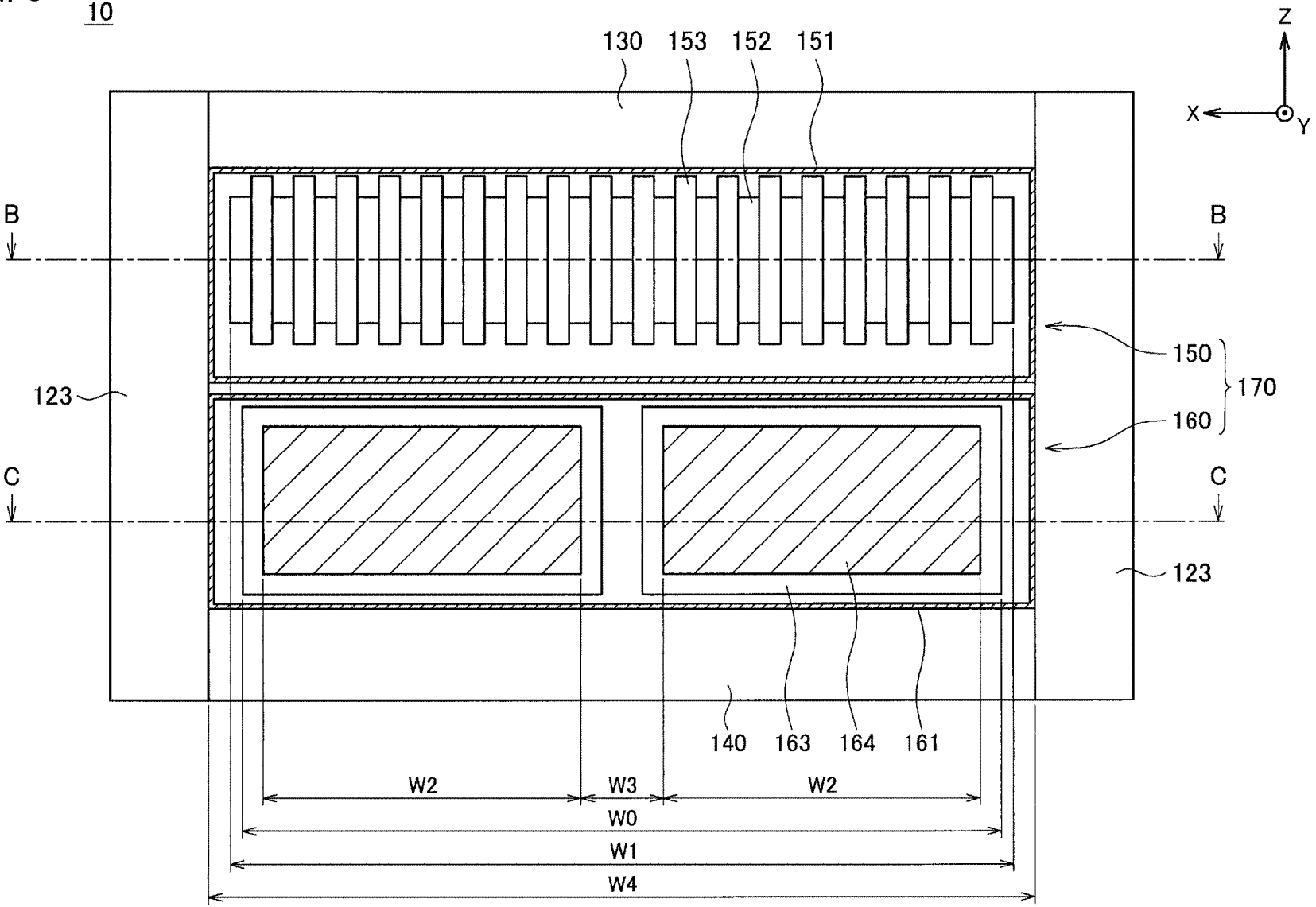
FIG. 3 is a cross-sectional view of a molding facility at an A-A cross-section shown in FIG. 2.
Figure 4:
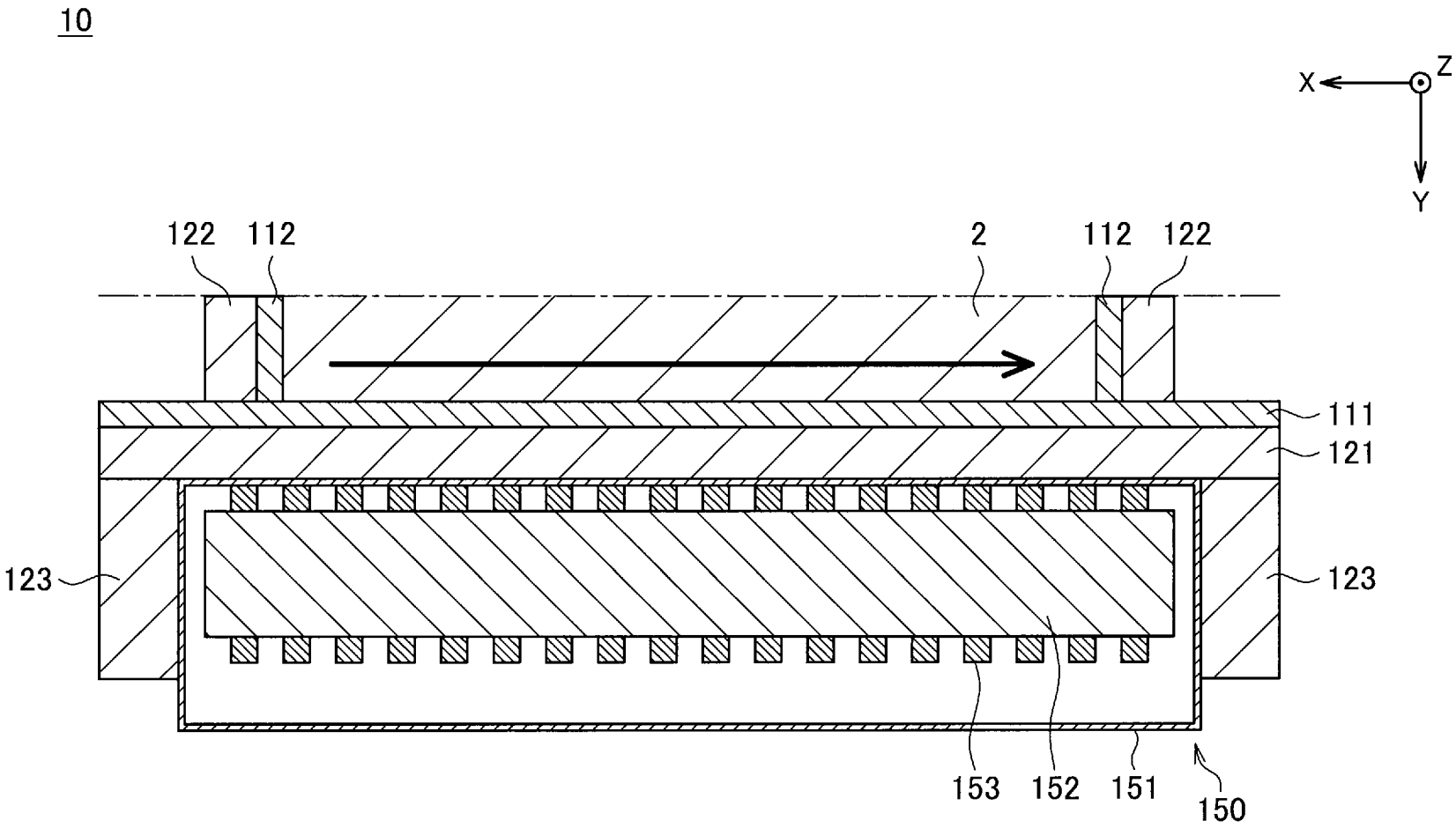
FIG. 4 is a cross-sectional view of a molding facility at a B-B cross-section shown in FIG. 3.
Figure 5:
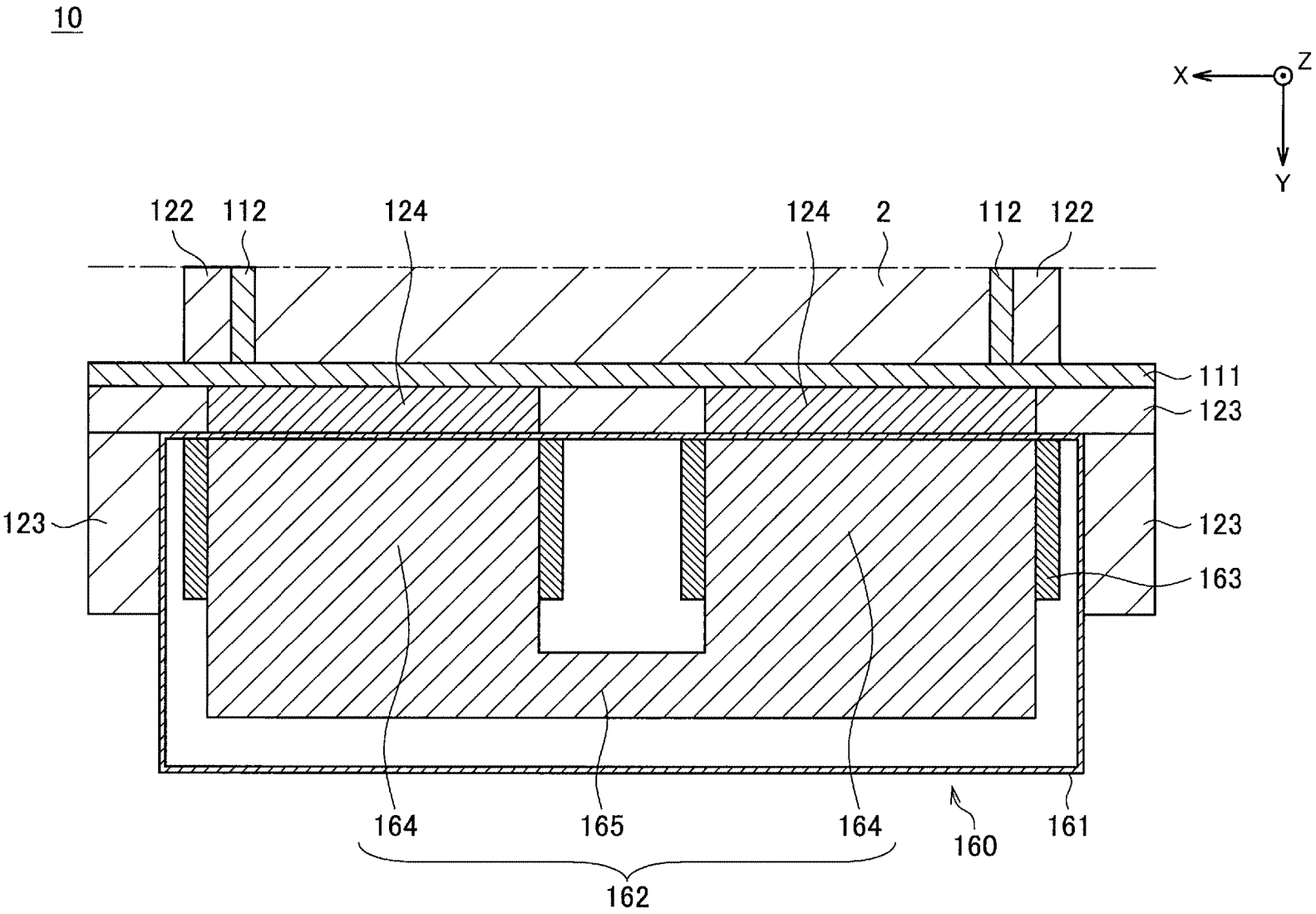
FIG. 5 is a cross-sectional view of a molding facility at a C-C cross-section shown in FIG. 3.

FIG. 2 is a cross-sectional view of the molding facility 10 according to the present embodiment in the Y-Z plane. FIG. 3 is a cross-sectional view of the molding facility 10 at the A-A cross-section shown in FIG. 2. FIG. 4 is a cross-sectional view of the molding facility 10 at the B-B cross-section shown in FIG. 3 FIG. 5 is a cross-sectional view of the molding facility 10 at the C-C cross-section shown in FIG. 3. Note that, the molding facility 10 has a symmetric configuration about the center of the mold 110 in the Y-axis direction, so in FIG. 2, FIG. 4, and FIG. 5, only the portions corresponding to one long side mold plate 111 are illustrated. Further, in FIG. 2, FIG. 4, and FIG. 5, to facilitate understanding, the molten steel 2 inside the mold 110 is also illustrated.

Referring to FIG. 2 to FIG. 5, the molding facility 10 according to the present embodiment is configured with two water boxes 130, 140 and an electromagnetic force generating device 170 set at the outside surface of a long side mold plate 111 of the mold 110 through the backup plates 121.

The mold 110, as explained above, is assembled so that a pair of long side mold plates 111 sandwich a pair of short side mold plates 112 from the both sides. The mold plates 111, 112 are made of copper plates. However, the present embodiment is not limited to such an example. The mold plates 111, 112 may be formed by various types of materials generally used as molds of continuous casting machines.

The present embodiment covers continuous casting of slabs of ferrous metals. The cast slab size is a width of (that is, length in X-axis direction) of 800 to 2300 mm or so and a thickness (that is, length in Y-axis direction) of 200 to 300 mm or so. That is, the mold plates 111, 112 also have sizes corresponding to the cast slab size. That is, the long side mold plates 111 have widths in the X-axis direction at least longer than the widths of 800 to 2300 mm of the cast slab 3 while the short side mold plates 112 have widths in the Y-axis direction substantially the same as the thickness of 200 to 300 mm of the cast slab 3.

Further, while explained in detail later, in the present embodiment, to more effectively obtain the effect of improvement of the quality of the cast slab 3 by the electromagnetic force generating device 170, the mold 110 is configured to be as long as possible in length in the Z-axis direction. In general, it is known that as the molten steel 2 increasingly solidifies inside the mold 110, due to shrinkage upon solidification, the cast slab 3 ends up separating from the inside walls of the mold 110 and sometimes the cast slab 3 is not sufficiently cooled. Therefore, the length of the mold 110 is made at the longest 1000 mm or so from the surface of the molten steel as a limit. In the present embodiment, considering such a situation, the mold plates 111, 112 are formed so as to have lengths in the Z-axis direction sufficiently larger than the 1000 mm so that the lengths from the surface of the molten steel to the bottom ends of the mold plates 111, 112 become 1000 mm or so.

The backup plates 121, 122 are, for example, comprised of stainless steel. They are provided so as to cover the outside surfaces of the mold plates 111, 112 so as to reinforce the mold plates 111, 112 of the mold 110. Below, for differentiation, the backup plates 121 provided at the outside surfaces of the long side mold plates 111 will also be referred to as the long side backup plates 121 while the backup plates 122 provided at the outside surfaces of the short side mold plates 112 will also be referred to as the short side backup plates 122.

In the electromagnetic force generating device 170, to impart electromagnetic force to the molten steel 2 in the mold 110 through the long side backup plate 121, at least the long side backup plate 121 can be formed by a nonmagnetic material (for example, nonmagnetic stainless steel etc.) However, to achieve the high magnetic flux of the electromagnetic brake device 160 at the location of the long side backup plate 121 facing the end part 164 of the core 162 of the electromagnetic brake device 160 explained later (below, also referred to as the "electromagnetic brake core 162"), magnetic soft iron 124 is buried.

At the long side backup plate 121, further, a pair of backup plates 123 are provided extending toward the direction (Y-axis direction) vertical to the long side backup plate 121. As shown in FIG. 3 to FIG. 5, the electromagnetic force generating device 170 is provided between this pair of backup plates 123. In this way, the backup plates 123 can prescribe the width of the electromagnetic force generating device 170 (that is, the length in the X-axis direction) and the set position in the X-axis direction. In other words, the mounting positions of the backup plates 123 are determined so that the electromagnetic force generating device 170 can impart electromagnetic force to a desired range of the molten steel 2 in the mold 110. Below, for differentiation, the backup plates 123 will also be referred to as "width direction backup plates 123". The width direction backup plates 123 are also formed by for example stainless steel in the same way as the backup plates 121, 122.

The water boxes 130, 140 store cooling water for cooling the mold 110. In the present embodiment, as illustrated, one water box 130 is set at a region of a predetermined distance from a top end of a long side mold plate 111 while the other water box 140 is set at a region of a predetermined distance from a bottom end of the long side mold plate 111. By providing the water boxes 130, 140 above and below the mold 110 in this way, it becomes possible to achieve space for setting the electromagnetic force generating device 170 between the water boxes 130, 140. Below, for differentiation, the water box 130 provided above the long side mold plate 111 will also be referred to as the "upper water box 130" while the water box 140 provided below the long side mold plate 111 will also be referred to as the "lower water box 140".

Inside the long side mold plates 111 or between the long side mold plates 111 and the long side backup plates 121, channels (not shown) are formed for the cooling water to run through. These channels are extended up to the water boxes 130, 140. Using a not shown pump, cooling water flows from one of the water boxes 130, 140 to the other of the water boxes 130, 140 (for example, from the lower water box 140 toward the upper water box 130) through the channels. Due to this, the long side mold plates 111 are cooled and molten steel 2 inside the mold 110 is cooled through the long side mold plates 111. Note that, while illustration is omitted, the short side mold plates 112 are also provided with water boxes and water channels in the same way. Due to the flow motion of the cooling water, the short side mold plates 112 are cooled.

The electromagnetic force generating device 170 is provided with an electromagnetic stirring device 150 and an electromagnetic brake device 160. As illustrated, the electromagnetic stirring device 150 and the electromagnetic brake device 160 are set in the space between the water boxes 130, 140. Inside the space, the electromagnetic stirring device 150 is set above while the electromagnetic brake device 160 is set below. Note that, the heights of the electromagnetic stirring device 150 and the electromagnetic brake device 160 and the positions of setting the electromagnetic stirring device 150 and electromagnetic brake device 160 in the Z-axis direction will be explained in detail below (2-2. Details of Position of Setting Electromagnetic Force Generating Device).

The electromagnetic stirring device 150 applies a moving magnetic field to the molten steel 2 inside the mold 110 to thereby impart electromagnetic force to the molten steel 2. The electromagnetic stirring device 150 is driven to apply electromagnetic force in the width direction of the long side mold plate 111 where it is set (that is, the X-axis direction) to the molten steel 2. FIG. 4 shows the direction of the electromagnetic force imparted to the molten steel 2 by the electromagnetic stirring device 150 in a symbolic manner by the bold arrow. Here, the electromagnetic stirring device 150 provided at the long side mold plate 111 whose illustration is omitted (that is, the long side mold plate 111 facing the illustrated long side mold plate 111) is driven to impart an electromagnetic force in the opposite direction to the illustration along the width direction of the long side mold plate 111 where it is set. In this way, the pair of electromagnetic stirring devices 150 are driven so as to generate a swirling flow inside the horizontal plane. According to the electromagnetic stirring devices 150, by causing generation of such a swirling flow, the molten steel 2 at the solidified shell interface flows, a cleaning effect suppressing trapping of gas bubbles and inclusions at the solidified shell 3*a* is obtained, and the surface quality of the cast slab 3 can be improved.

The detailed configuration of the electromagnetic stirring device 150 will be explained. The electromagnetic stirring device 150 is comprised of a case 151, a core 152 stored inside the case 151 (below, also referred to as an electromagnetic stirring core 152), and a plurality of coils 153 configured by conductors wound around the electromagnetic stirring core 152.

The case 151 is a hollow member having a substantially box shape. The size of the case 151 can be suitably determined so that the electromagnetic stirring device 150 can impart electromagnetic force to a desired range of the molten steel 2, that is, so that the coil 153 provided at the inside can be arranged at a suitable position with respect to the molten steel 2. For example, the width W4 of the case 151 in the X-axis direction, that is, the width W4 of the electromagnetic stirring device 150 in the X-axis direction, is determined to become larger than the width of the cast slab 3 so as to be able to impart electromagnetic force to the molten steel 2 inside the mold 110 at any position in the X-axis direction. For example, W4 is 1800 mm to 2500 mm or so. Further, in the electromagnetic stirring device 150, electromagnetic force is imparted to the molten steel 2 from the coil 153 through the side walls of the case 151, so as the material of the case 151, for example, a nonmagnetic stainless steel or FRP (fiber reinforced plastic) or other nonmagnetic and strength-securing member is used.

The electromagnetic stirring core 152 is a solid member having a substantially box shape. Inside the case 151, it is set so that its long direction becomes substantially parallel to the width direction (that is, the X-axis direction) of the long side mold plate 111. The electromagnetic stirring core 152 is, for example, formed by stacking electromagnetic steel sheets.

A conductor is wound around the electromagnetic stirring core 152 centered about the X-axis direction whereby the coil 153 is formed. As such a conductor, for example, a copper one having a 10 mm×10 mm cross-section and having a diameter 5 mm or so cooling water channel inside it is used. At the time of application of current, the cooling water channel is used to cool the conductor. This conductor is insulated at its surface layer by insulating paper etc. and can be wound in layers. For example, one coil 153 is formed by winding the conductor in two to four layers. A coil 153 having a similar configuration is provided alongside it at a predetermined interval in the X-axis direction.

Not shown AC power supplies are connected to the respective coils 153. Due to the AC power supplies, current is applied to the coils 153 so that the phases of the currents at the adjoining coils 153 are suitably offset, whereby electromagnetic force causing a swirling flow can be given to the molten steel 2. Note that, the drive operation of the AC power supply can be suitably controlled by operation of a processor or other control device (not shown) in accordance with a predetermined program. Due to this control device, the amounts of current applied to the respective coils 153, the timing of applying currents to the coils 153, etc. are suitably controlled and the strength of the electromagnetic force given to the molten steel 2 can be controlled. As the method of driving this AC power supply, various known methods used in general electromagnetic stirring devices may be used, so here detailed explanations will be omitted.

The width W1 of the electromagnetic stirring core 152 in the X-axis direction can be suitably determined so as to enable the electromagnetic stirring device 150 to impart electromagnetic force to a desired range of the molten steel 2, that is, so that the coil 153 can be placed at a suitable position with respect to the molten steel 2. For example, W1 is 1800 mm or so.

Figure 6:
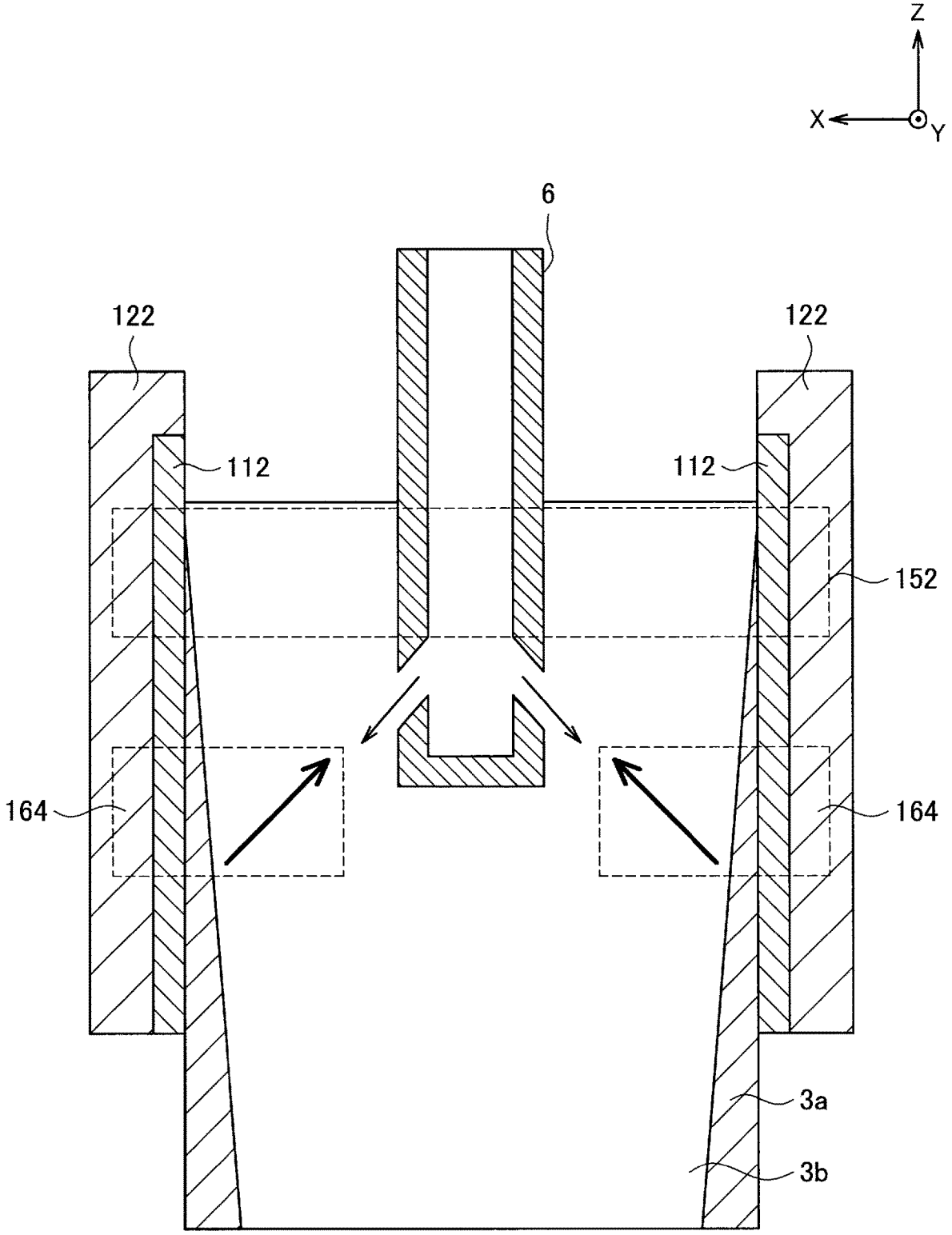
FIG. 6 is a view for explaining the direction of the electromagnetic force imparted by the electromagnetic brake device to the molten steel.

The electromagnetic brake device 160 can apply a stationary magnetic field to the molten steel 2 in the mold 110 to thereby impart an electromagnetic force to the molten steel 2. Here, FIG. 6 is a view for explaining the direction of the electromagnetic force imparted by the electromagnetic brake device 160 to the molten steel 2. In FIG. 6, the cross-section of the configuration near the mold 110 in the X-Z plane is schematically shown. Further, in FIG. 6, the electromagnetic stirring core 152 and the position of the end part 164 of the electromagnetic brake core 162 explained later are shown by a broken line in a symbolic manner.

As shown in FIG. 6, the submerged nozzle 6 can be provided with a pair of discharge holes at positions facing the short side mold plates 112. The electromagnetic brake device 160 is driven so as to impart to the molten steel 2 an electromagnetic force in a direction restraining the flow of molten steel 2 (discharge flow) from the discharge holes of the submerged nozzle 6. FIG. 6 shows the direction of the discharge flow by a fine arrow in a symbolic manner and shows the direction of the electromagnetic force imparted by the electromagnetic brake device 160 to the molten steel 2 in a symbolic manner. According to the electromagnetic brake device 160, by causing the generation of electromagnetic force in a direction restraining such a discharge flow, the effect is obtained of the descending flow being restrained and the flotation and separation of gas bubbles and inclusions being promoted and the inside quality of the cast slab 3 can be improved.

The detailed configuration of the electromagnetic brake device 160 will be explained. The electromagnetic brake device 160 is comprised of a case 161, an electromagnetic brake core 162 partially stored in the case 161, and a plurality of coils 163 comprised of conductors wound at portions of the electromagnetic brake core 162 inside the case 161.

The case 161 is a hollow member having a substantially box shape. The size of the case 161 can be suitably determined so that the electromagnetic brake device 160 can impart electromagnetic force to the desired range of the molten steel 2, that is, so that the coils 163 provided at the inside can be arranged at suitably positions with respect to the molten steel 2. For example, the width W4 of the case 161 in the X-axis direction, that is, the width W4 of the electromagnetic brake device 160 in the X-axis direction, is determined to become larger than the width of the cast slab 3 so that electromagnetic force can be imparted to the molten steel 2 inside the mold 110 at a desired position of the X-axis direction. In the illustrated example, the width W4 of the case 161 is substantially the same as the width W4 of the case 151. Provided, however, the present embodiment is not limited to such an example. The width of the electromagnetic stirring device 150 and the width of the electromagnetic brake device 160 may also be different.

Further, in the electromagnetic brake device 160, electromagnetic force is imported to the molten steel 2 from the coil 163 through the side wall of the case 161, so the case 161, in the same way as the case 151, for example, is formed by nonmagnetic stainless steel or FRP or other nonmagnetic and strength-securing material.

The electromagnetic brake core 162 is comprised of a pair of end parts 164 of solid members having substantially box shapes and at which coils 163 are provided and a connecting part 165 of a solid member also having substantially a box shape connecting the pair of end parts 164. The electromagnetic brake core 162 is configured provided with a pair of end parts 164 so as to stick out from the connecting part 165 in the Y-axis direction of the direction heading toward the long side mold plate 111. The positions at which the pair of end parts 164 are provided can be made positions at which the electromagnetic force is desired to be imparted to the molten steel 2, that is, positions where the discharge flow from the pair of discharge holes of the submerged nozzle 6 passes through regions where a magnetic field will be applied by the coils 163 (see FIG. 6 as well). The electromagnetic brake core 162 is, for example, formed by stacking electromagnetic steel sheets.

The coils 163 are formed by winding conductors around the end parts 164 of the electromagnetic brake core 162 centered about the Y-axis direction. The structures of the coils 163 are similar to the coils 153 of the electromagnetic stirring device 150. The end parts 164 are respectively provided with pluralities of coils 163 alongside in the Y-axis direction at predetermined intervals.

The respective coils 163 have not shown DC power supplies connected to them. By applying DC currents to the coils 163 by the DC power supplies, electromagnetic force can be applied to the molten steel 2 weakening the strengths of the discharge flow. Note that, the drive operations of the DC power supplies can be suitably controlled by operation of a processor other control device (not shown) in accordance with a predetermined program. Due to this control device, the amounts of current supplied to the respective coils 163 etc. are suitably controlled and the strength of the electromagnetic force given to the molten steel 2 can be controlled. As the method of driving the DC power supplies, various known methods used in general electromagnetic brake devices may be used, so here detailed explanations will be omitted.

The width W0 of the electromagnetic brake core 162 in the X-axis direction, the width W2 of the end parts 164 in the X-axis direction, and the distance W3 between the end parts 164 in the X-axis direction can be suitably determined so as to enable the electromagnetic stirring device 150 to impart electromagnetic force to a desired range of the molten steel 2, that is, so that the coil 163 can be placed at a suitable position with respect to the molten steel 2. For example, W0 is 1600 mm or so, W2 is 500 mm or so, and W3 is 350 mm or so.

Here, for example, as in the art described in PTL 1, as the electromagnetic brake device, there are ones having single magnetic poles and generating a uniform magnetic field in the width direction of the mold. In an electromagnetic brake device having such a configuration, there is the defect that a uniform electromagnetic force is imparted in the width direction, so it is not possible to control in detail the range in which electromagnetic force is imparted and suitable casting conditions are limited.

As opposed to this, in the present embodiment, in the above way, the electromagnetic brake device 160 is configured so as to have two end parts 164, that is, so as to have two magnetic poles. In other words, in the present embodiment, by having two magnetic poles, the electromagnetic brake device 160 is configured as a split brake. According to this configuration, for example, when driving the electromagnetic brake device 160, the control device can control the application of current to the coils 163 so that these two magnetic poles function respectively as the N pole and S pole and the magnetic flux becomes approximately zero in the region near the approximate center of the mold 110 in the width direction (that is, X-axis direction). The region where the magnetic flux is substantially zero is the region where electromagnetic force is substantially not imparted to the molten steel 2. This is a region in which so-called escape of the flow of molten steel released from the braking force by the electromagnetic brake device 160 can be achieved. By such a region being achieved, it becomes possible to deal with a broader range of casting conditions.

Note that, in the illustrated example of the configuration, the electromagnetic brake device 160 is configured to have two magnetic poles, but the present embodiment is not limited to such an example. The electromagnetic brake device 160 may also be configured to have three or more end parts 164 and to have three or more magnetic poles. In this case, the amounts of current applied to the coil 163 of the end parts 164 are suitably adjusted, whereby application of electromagnetic force to the molten steel 2 according to the electromagnetic brake can be further controlled in detail.

2-2. Details of Position of Placement of Electromagnetic Force Generating Device The heights of the electromagnetic stirring device 150 and electromagnetic brake device 160 and the set positions of the electromagnetic stirring device 150 and electromagnetic brake device 160 in the Z-axis direction will be explained.

In the electromagnetic stirring device 150 and the electromagnetic brake device 160, the greater the respective heights of the electromagnetic stirring core 152 and electromagnetic brake core 162, the higher the performance in imparting an electromagnetic force that can be said. For example, the performance of the electromagnetic brake device 160 depends on the cross-sectional area of the end part 164 of the electromagnetic brake core 162 in the X-Z plane (height H2 in Z-axis direction×width W2 in X-axis direction), the value of the DC current applied, and the number of turns of the coil 163. Therefore, when setting both of the electromagnetic stirring device 150 and electromagnetic brake device 160 at the mold 110, the installation position of the electromagnetic stirring core 152 and electromagnetic brake core 162 in the limited installation space, more specifically how to set the ratio of heights of the electromagnetic stirring core 152 and the electromagnetic brake core 162 is extremely important from the viewpoint of more effectively drawing out the performances of the devices for improving the quality of the cast slab 3.

Here, as disclosed in the above PTLs 1 and 2 as well, in the past, the method of using both an electromagnetic stirring device and an electromagnetic brake device in continuous casting has been proposed. However, in actuality, even if combining an electromagnetic stirring device and an electromagnetic brake device, the quality of the cast slab ends up deteriorating in quite a few cases compared with when using the electromagnetic stirring device or the electromagnetic brake device alone. This is because the strong points of both devices are not simply obtained if just providing both devices. Depending on the configurations of the devices and set positions etc., the respective strong points can end up cancelling each other out. In PTLs 1 and 2 as well, the specific hardware configurations are not clearly shown. The heights of the cores of the two devices are also not clearly shown. That is, with the conventional method, it cannot be said that the effect of improvement of the quality of the cast slab can be sufficiently obtained by providing both of the electromagnetic stirring device and electromagnetic brake device.

As opposed to this, in the present embodiment, as explained above, the ratio of suitable heights of the electromagnetic stirring core 152 and electromagnetic brake core 162 is prescribed so that the quality of the cast slab 3 can be achieved even with high speed casting. Due to this, it becomes possible to achieve the quality of the cast slab 3 while improving the productivity.

Here, the casting speed in continuous casting greatly differs depending on the size of the cast slab or the type of product, but in general is 0.6 to 2.0 m/min or so. Continuous casting exceeding 1.6 m/min is called "high speed casting". In the past, for automobile use external panels etc. where high quality is demanded, with high speed casting with a casting speed of over 1.6 m/min, securing the quality is difficult, so 1.4 m/min or so is the general casting speed.

Therefore, in the present embodiment, in consideration of the above situation, for example, even at high speed casting with a casting speed of over 1.6 m/min, securing a quality of the cast slab 3 equal to or better than that when performing continuous casting by a conventional slower casting speed is set as a specific target. Below, the ratio of heights of the electromagnetic stirring core 152 and electromagnetic brake core 162 in the present embodiment enabling this target to be satisfied will be explained in detail.

As explained above, in the present embodiment, to secure space for setting the electromagnetic stirring device 150 and electromagnetic brake device 160 at the center part of the mold 110 in the Z-axis direction, the water boxes 130, 140 are placed above and below the mold 110. Here, even if the electromagnetic stirring core 152 is positioned above from the surface of the molten steel, it is not possible to obtain that effect. Therefore, the electromagnetic stirring core 152 should be arranged below the surface of the molten steel. Further, to effectively apply the magnetic field to the discharge flow, the electromagnetic brake core 162 is preferably positioned near the discharge holes of the submerged nozzle 6. In arranging the water boxes 130, 140 in this way, the discharge holes of the submerged nozzle 6 become positioned above the lower water box 140, so the electromagnetic brake core 162 should be set above from the lower water box 140. Therefore, the height H0 of the space at which the effect is obtained by setting the electromagnetic stirring core 152 and electromagnetic brake core 162 (below, also referred to as the "effective space") becomes the height from the surface of the molten steel to the top end of the lower water box 140 (see FIG. 2).

In the present embodiment, to make the most effective use of this effective space, the electromagnetic stirring core 152 is set so that the top end of the electromagnetic stirring core 152 becomes substantially the same height as the surface of the molten steel. At this time, if expressing the height of the electromagnetic stirring core 152 of the electromagnetic stirring device 150 as H1, the height of the case 151 as H3, the height of the electromagnetic brake core 162 of the electromagnetic brake device 160 as H2, and the height of the case 161 as H4, the following numerical formula (1) stands.

[Mathematical 3]

$$H1 + \frac{H3 - H1}{2} + H4 = \frac{H1 + H3}{2} + H4 \leq H0 \quad (1)$$

In other words, it is necessary to satisfy the above numerical formula (1) while prescribing the ratio H1/H2 between the height H1 of the electromagnetic stirring core 152 and the height H2 of the electromagnetic brake core 162 (below, also referred to as the "core height ratio H1/H2"). Below, the heights H0 to H4 will be respectively explained.

Regarding Height H0 of Effective Space

As explained above, in the electromagnetic stirring device 150 and electromagnetic brake device 160, the greater the heights of the electromagnetic stirring core 152 and electromagnetic brake core 162, the higher the performance in imparting an electromagnetic force which can be said. Therefore, in the present embodiment, the molding facility 10 is configured so that the height H0 of the effective space becomes as large as possible so that the two devices can better exert their performances. Specifically, to increase the height H0 of the effective space, it is sufficient to enlarge the length of the mold 110 in the Z-axis direction. On the other hand, as explained above, considering the coolability of the cast slab 3, the length from the surface of the molten steel to the bottom end of the mold 110 is preferably 1000 mm or so or less. Therefore, in the present embodiment, to achieve the coolability of the cast slab 3 while increasing the height H0 of the effective space as much as possible, the mold 110 is formed so that the length from the surface of the molten steel to the bottom end of the mold 110 becomes 1000 mm or so.

Here, if trying to configure the lower water box 140 so as to be able to store an amount of water enough for a sufficient cooling capability to be obtained, based on past results of operations etc., the height of the lower water box 140 has to be at least 200 mm or so. Therefore, the height H0 of the effective space is 800 mm or so or less.

Regarding Heights H3, H4 of Cases of Electromagnetic Stirring Device and Electromagnetic Brake Device As explained above, the coil 153 of the electromagnetic stirring device 150 is formed by winding a conductor with a cross-sectional size of 10 mm×10 mm or so in two to four layers around an electromagnetic stirring core 152. Therefore, the height of the electromagnetic stirring core 152 including up to the coil 153 becomes H1+80 mm or so or more. If considering the space between the inside wall of the case 151 and the electromagnetic stirring core 152 and coil 153, the height H3 of the case 151 becomes H1+200 mm or so or more.

For the electromagnetic brake device 160 as well, in the same way, the height of the electromagnetic brake core 162 including up to the coil 163 becomes H2+80 mm or so or more. If considering the space between the inside wall of the case 161 and the electromagnetic brake core 162 and coil 163, the height H4 of the case 161 becomes H2+200 mm or so or more.

Range which H1+H2 can Take

If entering the values of the above-mentioned H0, H3, and H4 in the above numerical formula (1), the following numerical formula (2) is obtained.

[Mathematical 4]

$$H1+H2 \leq 500 \text{ mm} \tag{2}$$

That is, the electromagnetic stirring core 152 and electromagnetic brake core 162 have to be configured so that the sum of the heights H1+H2 becomes 500 mm or so or less. Below, the suitable core height ratio H1/H2 satisfying the above numerical formula (2) while sufficiently obtaining the effect of improvement of the quality of the cast slab 3 will be studied.

Regarding Core Height Ratio H1/H2

In the present embodiment, the suitable range of the core height ratio H1/H2 is set by prescribing the range of height H1 of the electromagnetic stirring core 152 by which the effect of electromagnetic stirring can be more reliably obtained.

As explained above, in electromagnetic stirring, by making the molten steel 2 flow at the interface of the solidified shell, a cleaning effect is obtained of keeping impurities from being trapped at the solidified shell 3*a* and the surface quality of the cast slab 3 can be improved. On the other hand, the further downward in the mold 110, the greater the thickness of the solidified shell 3*a* inside the mold 110. The effect of electromagnetic stirring extends to the unsolidified part 3*b* at the inside of the solidified shell 3*a*, so the height H1 of the electromagnetic stirring core 152 can be determined by to what extent of thickness the surface quality of the cast slab 3 has to be achieved.

Here, in a type of product with tough demands on surface quality, often a process is performed of grinding the surface layer of the cast slab 3 after casting down by a few millimeters. The depth of grinding is 2 mm to 5 mm or so. Therefore, in such a type of product with tough demands on surface quality, even if performing electromagnetic stirring in a range of thickness of the solidified shell 3*a* smaller than 2 mm to 5 mm in the mold 110, the surface layer of the cast slab 3 reduced in impurities by this electromagnetic stirring ends up being removed by a subsequent grinding process. In other words, if not performing electromagnetic stirring in a range of thickness of the solidified shell 3*a* of 2 mm to 5 mm or more in the mold 110, the effect of improvement of the surface quality at the cast slab 3 cannot be obtained.

It is known that the solidified shell 3*a* gradually grows from the surface of the molten steel and the thickness is shown by the following numerical formula (3). Here, δ is the thickness of the solidified shell 3*a* (m), "k" is a constant dependent on the cooling ability, "x" is the distance from the surface of the molten steel (m), and Vc is the casting speed (m/min).

[Mathematical 5]

$$\delta = k\sqrt{\frac{x}{Vc}} \tag{3}$$

Figure 7:
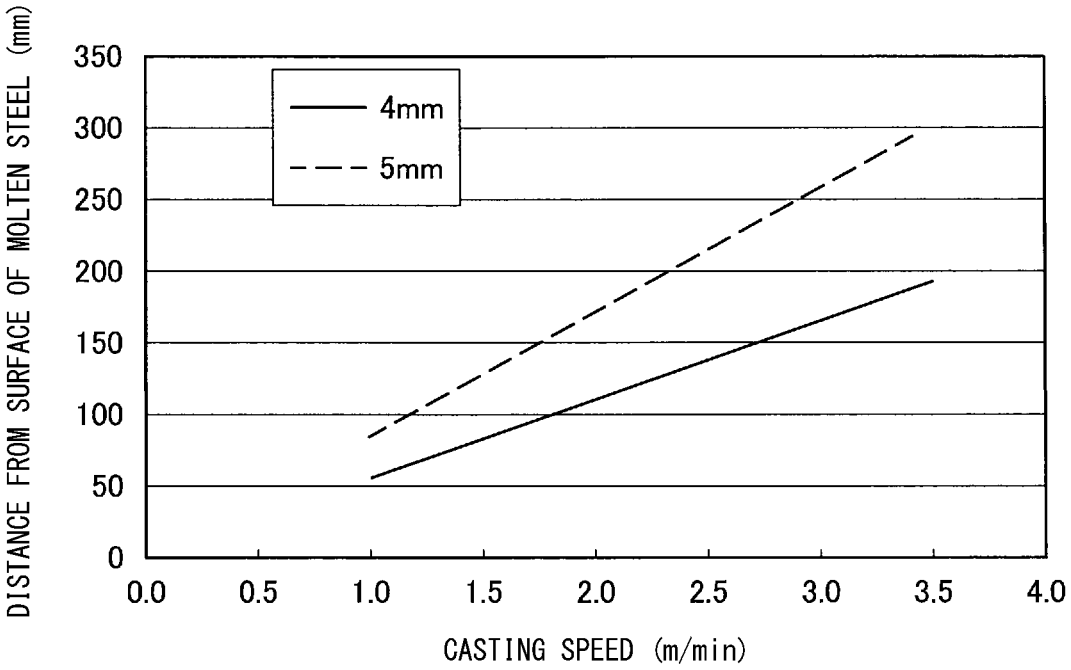
FIG. 7 is a view showing the relationship between the casting speed (m/min) and the distance from the surface of the molten steel (mm) when the thickness of the solidified shell becomes 4 mm or 5 mm.

From the above numerical formula (3), the relationship between the casting speed (m/min) and the distance from the surface of the molten steel in the case where the thickness of the solidified shell 3*a* becomes 4 mm or 5 mm was found. FIG. 7 shows the results. FIG. 7 is a view showing the relationship between the casting speed (m/min) and distance from the surface of the molten steel (mm) in the case where the thickness of the solidified shell 3*a* becomes 4 mm or 5 mm. In FIG. 7, the casting speed is taken along the abscissa while the distance from the surface of the molten steel is taken along the ordinate. The relationship between the two is plotted when the thickness of the solidified shell 3*a* becomes 4 mm and thickness of the solidified shell 3*a* becomes 5 mm. Note that, in the calculations when obtaining the results shown in FIG. 7, the value corresponding to the general mold was made k=17.

For example, from the results shown in FIG. 7, it will be understood that if the thickness ground down is smaller than 4 mm and the molten steel 2 may be electromagnetically stirred in a range of thickness of the solidified shell 3*a* of up to 4 mm, by making the height H1 of the electromagnetic stirring core 152 200 mm, the effect of electromagnetic stirring is obtained in continuous casting by a casting speed of 3.5 m/min or less. It will be understood that if the thickness ground down is smaller than 5 mm and the molten steel 2 may be electromagnetically stirred in a range of thickness of the solidified shell 3*a* of up to 5 mm, by making the height H1 of the electromagnetic stirring core 152 300 mm, the effect of electromagnetic stirring is obtained in continuous casting by a casting speed of 3.5 m/min or less. Note that, the value of "3.5 m/min" of the casting speed corresponds to the maximum casting speed possible in operation and equipment in general continuous casting machines.

Here, as explained above, in the present embodiment, for example, the aim is to achieve a quality of the cast slab 3 equal to the case of performing continuous casting by a conventional slower casting speed even in high speed casting with a casting speed exceeding 1.6 m/min. If the casting speed exceeds 1.6 m/min, to obtain the effect of electromagnetic stirring even if the thickness of the solidified shell 3*a* becomes 5 mm, from FIG. 7, it is learned that the height H1 of the electromagnetic stirring core 152 has to be made at least about 150 mm or more.

From the results of the above studies, in the present embodiment, the electromagnetic stirring core 152 is configured so that the height H1 of the electromagnetic stirring core 152 becomes about 150 mm or more so as to obtain the effect of electromagnetic stirring even if the thickness of the solidified sheet 3*a* becomes 5 mm in, for example, continuous casting at a relatively high speed of a casting speed of over 1.6 m/min.

Regarding the height H2 of the electromagnetic brake core 162, as explained above, the greater the height H2, the higher the performance of the electromagnetic brake device 160. Therefore, it is sufficient to find the range of H2 corresponding to the range of height H1 of the electromagnetic stirring core 152 in the case where H1+H2=500 mm from the above numerical formula (2). That is, the height H2 of the electromagnetic brake core 162 is about 350 mm.

From the values of the height H1 of the electromagnetic stirring core 152 and the height H2 of the electromagnetic brake core 162, the core height ratio H1/H2 of the present embodiment becomes, for example, the following numerical formula (4).

[Mathematical 6]

$$0.43 \leq \frac{H1}{H2} \tag{4}$$

Summarizing this, in the present embodiment, when aiming at securing a quality of the cast slab 3 equal to or better than when performing continuous casting by a conventional lower casting speed even when exceeding a casting speed of 1.6 m/min, for example, the electromagnetic stirring core 152 and the electromagnetic brake core 162 are configured so that the height H1 of the electromagnetic stirring core 152 and the height H2 of the electromagnetic brake core 162 satisfy the above numerical formula (4).

Note that, the preferable upper limit value of the core height ratio H1/H2 can be prescribed by the smallest value which the height H2 of the electromagnetic brake core 162 can take. This is because the smaller the height H2 of the electromagnetic brake core 162, the larger the core height ratio H1/H2 becomes, but if the height H2 of the electromagnetic brake core 162 is too small, the electromagnetic brake will not effectively function and the effect of improvement of the quality of the cast slab 3 by the electromagnetic brake, in particular, the inside quality, can no longer be obtained. The smallest value of the height H2 of the electromagnetic brake core 162 at which the effect of the electromagnetic brake can be sufficiently obtained differs according to the size of the cast slab, the type of product, the casting speed, and other casting conditions. Therefore, the smallest value of the height H2 of the electromagnetic brake core 162, that is, the upper limit value of the core height ratio H1/H2, can for example be prescribed based on simulation by numerical analysis simulating the casting conditions in actual operations such as shown in Examples 1 to 3 and actual machine tests etc.

Above, the configuration of the molding facility 10 according to the present embodiment was explained. Note that, in the above explanation, when obtaining the relationship shown in the above numerical formula (4), the relationship was obtained assuming H1+H2=500 mm from the above numerical formula (2). However, the present embodiment is not limited to such an example. As explained above, to draw out the performance of the device more, H1+H2 is preferably as large as possible, so in the above example, H1+H2=500 mm was set. On the other hand, for example, considering the work efficiency when installing the water boxes 130, 140, electromagnetic stirring device 150, and electromagnetic brake device 160 etc., sometimes it may be preferable that there be clearance between these members in the Z-axis direction. If stressing more the work efficiency and other such factors in this way, it is not necessarily required that H1+H2=500 mm. For example, the core height ratio H1/H2 may be set using H1+H2=450 mm or H1+H2 being another value smaller than 500 mm.

Further, in the above explanation, when the casting speed would exceed 1.6 m/min, as a condition for obtaining the effect of the electromagnetic stirring even if the thickness of the solidified shell 3*a* becomes 5 mm, from FIG. 7, the smallest value of about 150 mm of the height H1 of the electromagnetic stirring core 152 was found and the value of the core height ratio H1/H2 at that time of 0.43 was made the lower limit value of that core height ratio H1/H2. However, the present embodiment is not limited to such an example. If the targeted casting speed is set faster, the lower limit value of the core height ratio H1/H2 may also change. That is, in actual operation, at the targeted casting speed, the smallest value of the height H1 of the electromagnetic stirring core 152 where the effect of electromagnetic stirring is obtained even if the thickness of the solidified shell 3*a* becomes 5 mm may be found from FIG. 7 and the core height ratio H1/H2 corresponding to that value of H1 may be made the lower limit value of the core height ratio H1/H2.

As one example, considering the work efficiency etc., it was tried to find the condition of the core height ratio H1/H2 in the case of targeting securing a quality of the cast slab 3 equal to or better than the case of making H1+H2=450 mm and performing continuous casting by a casting speed lower than the conventional lower speed casting speed even at a faster casting speed of 2.0 m/min. First, from FIG. 7, the condition is found for obtaining the effect of electromagnetic stirring even if the thickness of the solidified shell 3*a* becomes 5 mm in the case where the casting speed is 2.0 m/min or more. Referring to FIG. 7, when the casting speed is 2.0 m/min, at a position of a distance from the surface of the molten steel of about 175 mm. the thickness of the solidified shell becomes 5 mm. Therefore, if considering the margin, even if the thickness of the solidified shell 3*a* becomes 5 mm, the smallest value of the height H1 of the electromagnetic stirring core 152 where the effect of electromagnetic stirring can be obtained is found to be 200 mm or so. At this time, since H1+H2=450 mm, H2=250 mm, so the condition found for the core height ratio H1/H2 is expressed by the following numerical formula (5).

[Mathematical 7]

$$0.80 \leq \frac{H1}{H2} \tag{5}$$

That is, in the present embodiment, when aiming at securing a quality of the cast slab 3 equal to or better than the case of performing continuous casting by a conventional lower speed casting speed even at a casting speed of 2.0 m/min, it is sufficient be configure the electromagnetic stirring core 152 and electromagnetic brake core 162 so as to at least satisfy the above numerical formula (5). Note that regarding the upper limit value of the core height ratio H1/H2, as explained above, this may be prescribed based on simulation by numerical analysis simulating the casting conditions in actual operations and on actual machine tests etc.

In this way, in the present embodiment, the range of the core height ratio H1/H2 enabling a quality of the cast slab (surface quality and inside quality) equal to or better than conventional lower speed continuous casting even when making the casting speed increase can change in accordance with the specific value of the casting speed targeted and the specific value of H1+H2. Therefore, when setting a suitable range of the core height ratio H1/H2, it is sufficient to suitably set target values of the casting speed and H1+H2 considering the casting conditions at the time of actual operation and the configuration of the continuous casting machine 1 etc. and suitably find a suitable range of the core height ratio H1/H2 at that time by the method explained above.

Example 1

Simulation by numerical analysis was performed for confirming that the surface quality of the cast slab can be achieved by applying the present invention even if making the casting speed increase. In this simulation by numerical analysis, a calculation model was prepared simulating a cast mold facility 10 in which an electromagnetic force generating device 170 is placed according to the present embodiment explained with reference to FIG. 2 to FIG. 5 and the behavior of the molten steel and Ar gas bubbles in the molten steel during the continuous casting was calculated. The conditions of the simulation by numerical analysis were as follows:

Conditions of Simulation by Numerical Analysis

Width W1 of electromagnetic stirring core of electromagnetic stirring device: 1900 mm Current application conditions of electromagnetic stirring device: 680 A, 3.0 Hz Number of turns of coil of electromagnetic stirring device: 20 turns Width W2 of electromagnetic brake core of electromagnetic brake device: 500 mm Distance W3 between electromagnetic brake cores of electromagnetic brake device: 350 mm Current application conditions of electromagnetic brake device: 900 A Number of turns of coil of electromagnetic brake device: 120 turns Casting speed: 1.4 m/min or 2.0 m/min Mold width: 1600 mm Mold thickness: 250 mm Amount of Ar gas blown: 5 NL/min In evaluation of the surface quality, fluid simulations were run under the above conditions to calculate the flow rate of the molten steel, the solidification speed of the molten steel, and the distribution of Ar gas bubbles in the molten steel of the continuous casting machine and evaluate the Ar gas bubbles trapped at the solidified shell. Specifically, the probability $P_g$ of the Ar gas bubbles being trapped at the solidified shell was calculated by the function shown in the following numerical formula (6). Here, $C_0$ is a constant, while U is the flow rate of molten steel at the solidification interface.

[Mathematical 8]

$$P_g = \exp(-C_0 U \tag{6}$$

Further, the speed $\eta_g$ by which Ar gas bubbles are trapped at the solidified sheet at this time was calculated using the following numerical formula (7). Here, $n_g$ is the number density of Ar gas bubbles at the solidified shell interface, while $R_s$ is the solidification speed of the solidified shell.

[Mathematical 9]

$$\eta_g = \eta_g R_s P_g \tag{7}$$

Further, the number density $S_g$ of the Ar gas bubbles in the solidified shell was calculated using the following numerical formula (8). Here, $U_s$ is the speed of movement of the solidified shell in the direction of pull out of the cast slab.

[Mathematical 10]

$$\frac{\delta S_g}{\delta t} + \nabla \cdot (U_s S_g) = \eta_g \tag{8}$$

The number density $S_g$ of the Ar gas bubbles in the solidified shell calculated from the above numerical formula (8) was averaged over time and the number of Ar gas bubbles of a diameter of 1 mm trapped within a range of 4 mm from the surface layer of the cast slab was calculated as the pinhole index. The smaller the pinhole index, the higher the surface quality of the cast slab which can be said. Note that for details of the method of evaluation of the surface quality of a cast slab by the simulation by numerical analysis explained above, it is possible to refer to the prior application by the present applicant shown in Japanese Unexamined Patent Publication No. 2015-157309.

Note that, in the evaluation of the surface quality, simulation was performed based on the relationship shown in the above numerical formula (2) by the eight combinations of the height H1 of the electromagnetic stirring core and the height H2 of the electromagnetic brake core shown in the following Table 1 giving H1+H2=500 mm.

TABLE 1

| H1 (mm) | 150 | 200 | 225 | 250 | 300 | 350 | 375 | 400 |
|---|---|---|---|---|---|---|---|---|
| H2 (mm) | 350 | 300 | 275 | 250 | 200 | 150 | 125 | 100 |
| H1/H2 | 0.43 | 0.67 | 0.82 | 1.00 | 1.50 | 2.33 | 3.00 | 4.00 |

Further, for comparison, the surface quality of a cast slab when only an electromagnetic stirring device is set as one example of a conventional continuous casting method was also evaluated. The conventional continuous casting method evaluated corresponds to a continuous casting method using the molding facility 10 shown in FIG. 2 to FIG. 5 from which the electromagnetic brake device 160 has been removed. Further, in the calculations regarding the conventional continuous casting method, the height H1 of the electromagnetic stirring core was fixed at 250 mm. For the conventional continuous casting method, the pinhole index was calculated by a method similar to the method of calculation explained above except that no electromagnetic brake device 160 is set and that the height H1 of the electromagnetic stirring core was fixed at 250 mm.

Figure 8:
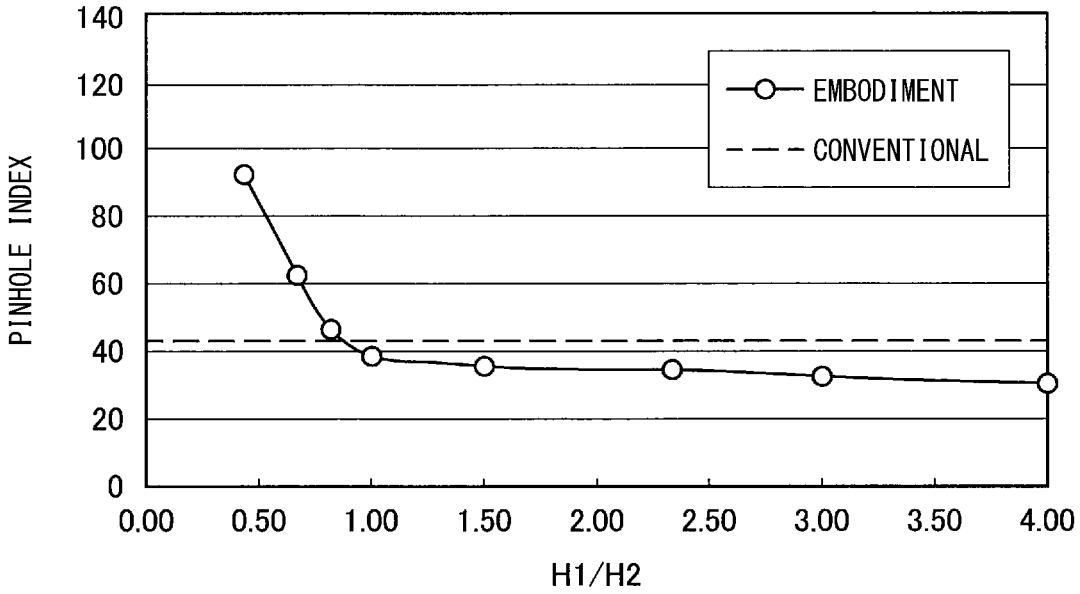
FIG. 8 is a graph showing the relationship between a core height ratio H1/H2 and a pinhole index in the case where the casting speed is 1.4 m/min obtained by simulation by numerical analysis.
Figure 9:
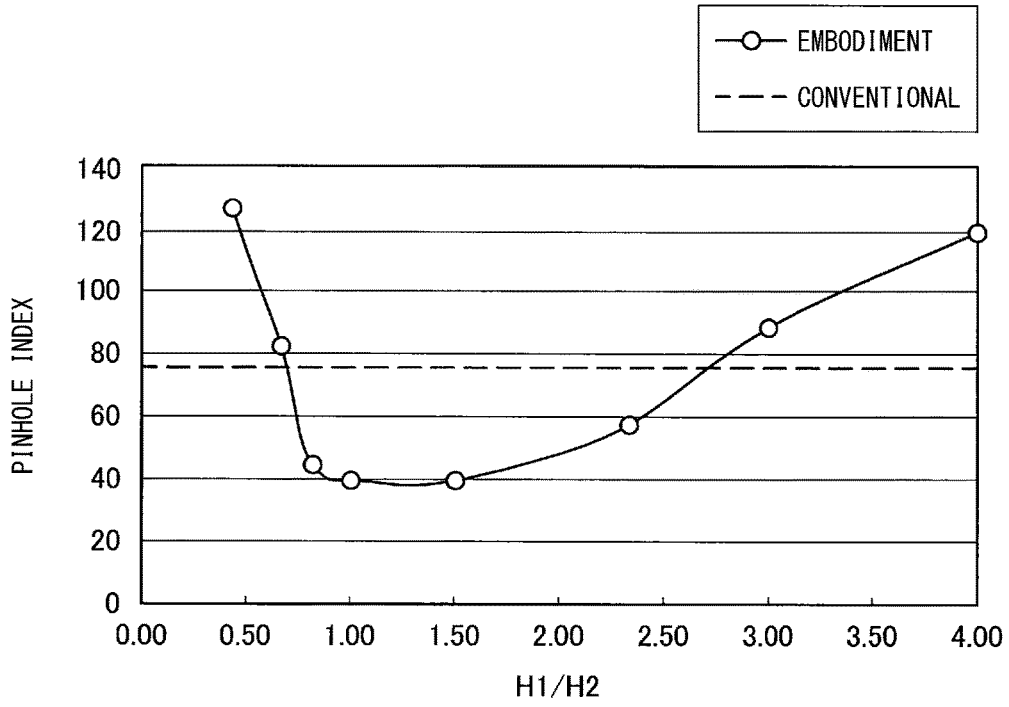
FIG. 9 is a graph showing the relationship between the core height ratio H1/H2 and the pinhole index in the case where the casting speed is 2.0 m/min obtained by simulation by numerical analysis.

The results of simulation of the surface quality by numerical analysis are shown in FIG. 8 and FIG. 9. FIG. 8 is a graph showing the relationship between the core height ratio H1/H2 and the pinhole index in the case where the casting speed is 1.4 m/min obtained by simulation by numerical analysis. FIG. 9 is a graph showing the relationship between the core height ratio H1/H2 and the pinhole index in the case where the casting speed is 2.0 m/min obtained by simulation by numerical analysis. In FIG. 8 and FIG. 9, the core height ratio H1/H2 is taken along the abscissa while the pinhole index is taken along the ordinate and the relationship of the two is plotted. Further, in FIG. 8 and FIG. 9, the value of the pinhole index in the above conventional continuous casting method is shown by the broken line parallel to the abscissa.

Referring to FIG. 8, if the casting speed is 1.4 m/min, the pinhole index in the conventional continuous casting method is 40 or so. On the other hand, in the continuous casting method according to the present embodiment, when the core height ratio H1/H2 is 0.82 or more, a pinhole index as much as up to the level of the conventional continuous casting method is obtained. In particular, if the core height ratio H1/H2 becomes 1.0 or more, the pinhole index falls from the conventional continuous casting method. Further, the pinhole index falls the larger the value of the core height ratio H1/H2. That is, it is believed that the larger the height H1 of the electromagnetic stirring core 152 with respect to the height H2 of the electromagnetic brake core 162, the more the pinhole index falls and the better the surface quality of the cast slab 3 becomes.

Referring to FIG. 9, if making the casting speed increase up to 2.0 m/min, the pinhole index in the conventional continuous casting method deteriorates to 80 or so. On the other hand, in the continuous casting method according to the present embodiment, if the core height ratio H1/H2 is about 0.70 to about 2.70, the pinhole index falls to equal to or less than the conventional continuous casting method. In particular, if the core height ratio H1/H2 is about 1.0 to about 1.5, the pinhole index decreases to 40 or so. It is learned that even if making the casting speed increase to 2.0 m/min, it is possible to obtain a surface quality equal to the case of performing continuous casting by the conventional continuous casting method by a casting speed of 1.4 m/min.

From the above results, it was learned that under the casting conditions corresponding to the conditions of the above simulation by numerical analysis, if making the core height ratio H1/H2 any value between about 0.70 to about 2.70, it becomes possible to achieve a surface quality of the cast slab equal to or better than that of a conventional continuous casting method in continuous casting with at least a casting speed of 1.4 m/min to 2.0 m/min. In particular, it was learned that if making the core height ratio H1/H2 about 1.0 to about 1.5, even if making the casting speed increase to 2.0 m/min, it becomes possible to obtain a surface quality of the cast slab equal to or better than that of a conventional lower speed (specifically, casting speed 1.4 m/min) continuous casting method.

Example 2

To confirm that the inside quality of the cast slab can be achieved by application of the present invention even if making the casting speed increase, simulation by numerical analysis was performed. Regarding the inside quality, a method of simulation similar to that when evaluating the surface quality explained above was used except that rather than Ar gas bubbles, the value of residual alumina, which is a typical impurity inclusion in a cast slab, present in the cast slab was evaluated. Specifically, a vertical curved type continuous casting machine was presumed, the behavior of alumina particles during the continuous casting was analyzed by simulation, the alumina particles descending from the vertical part were deemed remaining at the cast slab as they are, and the number of alumina particles in a predetermined volume of the cast slab was calculated as the inside quality index. At that time, the length of the vertical part of the continuous casting machine was made 3 m. Further, the diameter of the alumina particles was deemed 0.4 mm and the specific gravity of the alumina particles was deemed 3990 kg/m$^3$. The smaller the inside quality index, the higher the inside quality of the cast slab can be said.

Note that, in evaluation of the inside quality, the height H1 of the electromagnetic stirring core and the height H2 of the electromagnetic brake core were simulated based on the relationship shown in numerical formula (2) for the four combinations shown in the following Table 2 giving H1+H2=450 mm:

TABLE 2

| | | | | |
|---|---|---|---|---|
| H1 (mm) | 200 | 250 | 270 | 300 |
| H2 (mm) | 250 | 200 | 180 | 150 |
| H1/H2 | 0.80 | 1.25 | 1.50 | 2.00 |

Further, regarding the inside quality as well, for comparison, as one example of a conventional continuous casting method, the inside quality in the case of only the electromagnetic stirring device being installed was also evaluated. The evaluated conventional continuous casting method was a continuous casting method using the molding facility 10 according to the present embodiment shown in FIG. 2 to FIG. 5 in the same way as the time of evaluation of the above-mentioned surface quality but with the electromagnetic brake device 160 removed. Further, the electromagnetic stirring core height H1 of the electromagnetic stirring device was fixed at 250 mm.

Figure 10:
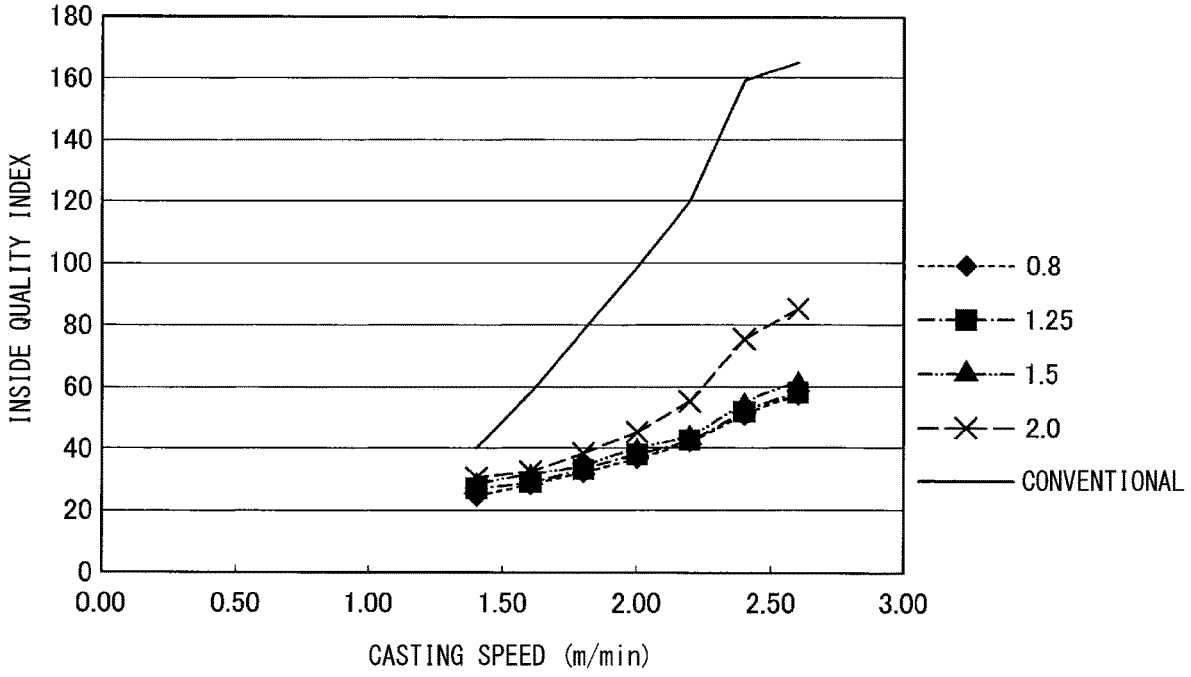
FIG. 10 is a graph showing the relationship between the casting speed and inside quality obtained by simulation by numerical analysis.

The results of simulation by numerical analysis of the inside quality are shown in FIG. 10. FIG. 10 is a graph showing the relationship between the casting speed and inside quality index obtained by simulation by numerical analysis. In FIG. 10, the casting speed is taken along the abscissa, while the inside quality index is taken along the ordinate. The relationship of the casting speed and inside quality index corresponding to the values of the core height ratio H1/H2 shown in Table 2 is plotted. Further, in FIG. 10, the results by the above conventional continuous casting method are also plotted.

Referring to FIG. 10, in the conventional continuous casting method, the inside quality index in the case of a general casting speed of 1.4 m/min is about 40. This inside quality index remarkably increases as the casting speed increases (that is, the inside quality of the cast slab remarkably deteriorates as the casting speed increases).

On the other hand, in the continuous casting method according to the present embodiment, when the core height ratio H1/H2 is 1.5 or less, even if making the casting speed increase to 2.0 m/min or so, the inside quality index is kept smaller than 40. An inside quality better than the case of the conventional continuous casting method where the casting speed is 1.4 m/min can be obtained. Even if the core height ratio H1/H2 is 2.0, if the casting speed is 2.4 m/min, the inside quality index is about 60. It is possible to achieve an inside quality equal to the case in the conventional continuous casting method where the casting speed is 1.6 m/min. From the above results, to achieve the inside quality of the cast slab as much as up to the level of the past even if making the casting speed a high speed, the core height ratio H1/H2 may be made 2.0 or less, more preferably 1.5 or less.

From the above results, it was learned that if making the core height ratio H1/H2 about 1.5 or less in the casting conditions corresponding to the conditions of simulation by numerical analysis, in continuous casting by a casting speed of 2.0 m/min, it becomes possible to achieve an inside quality of the cast slab as much as up to the level of the conventional continuous casting method at a casting speed of 1.4 m/min. Further, if making the core height ratio H1/H2 any value of about 2.0 or less, in continuous casting by a casting speed of 2.4 m/min, it becomes possible to achieve an inside quality of the cast slab as much as up to the level of the conventional continuous casting method at a casting speed of 1.6 m/min.

Example 3

To further confirm the advantageous effect of the present invention, an actual machine test was run. In this actual machine test, the electromagnetic force generating device 170 according to the present embodiment explained with reference to FIG. 2 to FIG. 5 was installed at a continuous casting machine being actually used for operations and that continuous casting machine was used for actual continuous casting while changing the core height ratio H1/H2 and casting speed in various ways. Further, the cast slab which was cast was investigated for surface quality and inside quality visually and by ultrasonic flaw detection. Further, for comparison, continuous casting was performed and the quality of the cast slab was evaluated by a similar method for a conventional continuous casting method in which only an electromagnetic stirring device was set. The conventional continuous casting method was made 1.6 m/min, while the height of the electromagnetic stirring core of the electromagnetic stirring device was made 200 mm.

Further, regarding the submerged nozzle, in both the present embodiment and the conventional continuous casting method, one with discharge holes facing downward at 45° was used. The depth of the tips of the discharge holes from the surface of the molten steel was made 270 mm.

The results are shown in the following Table 3. In Table 3, the quality of the cast slab is expressed, with reference to the quality in the conventional continuous casting method, as "G (Good)" when a quality better than that conventional continuous casting method is obtained, as "F (Fair)" when a quality of the same extent as that conventional continuous casting method is obtained, and as "P (Poor)" when a quality worse than that conventional continuous casting method is obtained.

TABLE 3

| | Casting | Electromagnetic stirring | | Electro-magnetic brake | Electro-magnetic stirring | Electro-magnetic brake | Core height | Quality of cast slab | |
|---|---|---|---|---|---|---|---|---|---|
| Con-dition | speed (m/min) | Current (A) | Frequency (Hz) | Magnetic flux (T) | core height H1(mm) | core height H2(mm) | ratio H1/H2 | Surface quality | Inside quality |
| 1 | 1.6 | 680 | 1.5 | 0.3 | 200 | 250 | 0.80 | G | G |
| 2 | 1.8 | 680 | 1.5 | 0.3 | 200 | 250 | 0.80 | G | G |
| 3 | 2.0 | 680 | 1.5 | 0.3 | 200 | 250 | 0.80 | G | G |
| 4 | 2.2 | 680 | 1.5 | 0.4 | 200 | 250 | 0.80 | F | G |
| 5 | 2.4 | 680 | 1.5 | 0.4 | 200 | 250 | 0.80 | P | F |
| 6 | 2.6 | 680 | 1.5 | 0.4 | 200 | 250 | 0.80 | P | P |
| 7 | 1.6 | 680 | 1.5 | 0.3 | 250 | 250 | 1.00 | G | G |
| 8 | 1.8 | 680 | 1.5 | 0.3 | 250 | 250 | 1.00 | G | G |
| 9 | 2.0 | 680 | 1.5 | 0.3 | 250 | 250 | 1.00 | G | G |
| 10 | 2.2 | 680 | 1.5 | 0.4 | 250 | 250 | 1.00 | G | G |
| 11 | 2.4 | 680 | 1.5 | 0.4 | 250 | 250 | 1.00 | F | F |
| 12 | 2.6 | 680 | 1.5 | 0.4 | 250 | 250 | 1.00 | P | P |
| 13 | 1.6 | 680 | 1.5 | 0.3 | 250 | 200 | 1.25 | G | G |
| 14 | 1.8 | 680 | 1.5 | 0.3 | 250 | 200 | 1.25 | G | G |
| 15 | 2.0 | 680 | 1.5 | 0.3 | 250 | 200 | 1.25 | G | G |
| 16 | 2.2 | 680 | 1.5 | 0.4 | 250 | 200 | 1.25 | G | G |
| 17 | 2.4 | 680 | 1.5 | 0.4 | 250 | 200 | 1.25 | F | F |
| 18 | 2.6 | 680 | 1.5 | 0.4 | 250 | 200 | 1.25 | P | P |
| 19 | 1.6 | 680 | 1.5 | 0.3 | 300 | 200 | 1.50 | G | G |
| 20 | 1.8 | 680 | 1.5 | 0.3 | 300 | 200 | 1.50 | G | G |
| 21 | 2.0 | 680 | 1.5 | 0.3 | 300 | 200 | 1.50 | G | G |
| 22 | 2.2 | 680 | 1.5 | 0.4 | 300 | 200 | 1.50 | G | G |
| 23 | 2.4 | 680 | 1.5 | 0.4 | 300 | 200 | 1.50 | G | G |
| 24 | 2.6 | 680 | 1.5 | 0.4 | 300 | 200 | 1.50 | P | P |
| 25 | 1.6 | 680 | 1.5 | 0.3 | 300 | 150 | 2.00 | G | G |
| 26 | 1.8 | 680 | 1.5 | 0.3 | 300 | 150 | 2.00 | G | G |
| 27 | 2.0 | 680 | 1.5 | 0.3 | 300 | 150 | 2.00 | G | G |
| 28 | 2.2 | 680 | 1.5 | 0.4 | 300 | 150 | 2.00 | G | G |
| 29 | 2.4 | 680 | 1.5 | 0.4 | 300 | 150 | 2.00 | F | F |
| 30 | 2.6 | 680 | 1.5 | 0.4 | 300 | 150 | 2.00 | P | P |
| 31 | 1.6 | 680 | 1.5 | 0.3 | 350 | 150 | 2.33 | G | G |
| 32 | 1.8 | 680 | 1.5 | 0.3 | 350 | 150 | 2.33 | G | G |
| 33 | 2.0 | 680 | 1.5 | 0.3 | 350 | 150 | 2.33 | G | G |
| 34 | 2.2 | 680 | 1.5 | 0.4 | 350 | 150 | 2.33 | F | G |
| 35 | 2.4 | 680 | 1.5 | 0.4 | 350 | 150 | 2.33 | P | F |
| 36 | 2.6 | 680 | 1.5 | 0.4 | 350 | 150 | 2.33 | P | P |
| 37 | 1.6 | 680 | 1.5 | 0.3 | 300 | 100 | 3.00 | G | G |
| 38 | 1.8 | 680 | 1.5 | 0.3 | 300 | 100 | 3.00 | G | G |
| 39 | 2.0 | 680 | 1.5 | 0.3 | 300 | 100 | 3.00 | G | F |
| 40 | 2.2 | 680 | 1.5 | 0.4 | 300 | 100 | 3.00 | F | P |
| 41 | 2.4 | 680 | 1.5 | 0.4 | 300 | 100 | 3.00 | P | P |
| 42 | 2.6 | 680 | 1.5 | 0.4 | 300 | 100 | 3.00 | P | P |

continuous casting method is a continuous casting method configured, in the same way as the time of simulation by numerical analysis explained above, like the molding facility 10 according to the present embodiment shown in FIG. 2 to FIG. 5 except with the electromagnetic brake device 160 removed. Further, the casting speed in the conventional In the present embodiment, the range of core height ratio H1/H2 enabling a better quality of the cast slab (surface quality and inside quality) than the conventional lower speed (specifically, casting speed ⅙ m/min) continuous casting method to be achieved even if the casting speed is made to increase to 2.0 m/min was investigated. From the results shown in Table 3, it was learned that in the casting conditions corresponding to the above actual machine test, by making the value of the core height ratio H1/H2 about 0.80 to about 2.33, even if making the casting speed increase up to 2.0 m/min, it becomes possible to achieve a quality of the cast slab better than the lower speed conventional continuous casting method. In other words, from the results of the present embodiment, it was shown that by applying the present invention and making the value of the core height ratio H1/H2 about 0.80 to about 2.33, it becomes possible to achieve the quality of the cast slab while making the casting speed increase to up to 2.0 m/min and improving the productivity. Further, in the same way, from the results shown in Table 3, it was learned that in the casting conditions corresponding to the above actual machine test, by making the value of the core height ratio H1/H2 about 1.00 to about 2.00, even if making the casting speed increase up to 2.2 m/min, it becomes possible to achieve a quality of the cast slab better than the lower speed conventional continuous casting method.

3. Additional

Above, while referring to the attached drawings, preferred embodiments of the present invention were explained in detail, but the present invention is not limited to such examples. A person having ordinary knowledge in the field to which the present invention belongs clearly could conceive of various changes or corrections within the scope of the technical idea described in the claims. It will be understood that these also fall under the technical scope of the present invention.

REFERENCE SIGNS LIST

1 continuous casting machine
2 molten steel
3 cast slab
3*a* solidified shell
3*b* unsolidified part
4 ladle
5 tundish
6 submerged nozzle
10 molding facility
110 mold
111 long side mold plate
112 short side mold plate
121, 122, 123 backup plate
130 upper water box
140 lower water box
150 electromagnetic stirring device
151 case
152 electromagnetic stirring core
153 coil
160 electromagnetic brake device
161 case
162 electromagnetic brake core
163 coil
164 end part
165 connecting part
170 electromagnetic force generating device

The invention claimed is:

1. A molding facility comprising
a mold for continuous casting use,
a first water box and second water box storing cooling water for cooling the mold,
an electromagnetic stirring device imparting to molten metal in the mold an electromagnetic force causing a swirling flow to be generated in a horizontal plane, and
an electromagnetic brake device imparting an electromagnetic force to a discharge flow of molten metal to an inside of the mold from a submerged nozzle in a direction braking the discharge flow, wherein
the first water box, the electromagnetic stirring device, the electromagnetic brake device, and the second water box being placed in that order from above to below at an outside surface of a long side mold plate of the mold,
a core height H1 of the electromagnetic stirring device and a core height H2 of the electromagnetic brake device satisfying a relationship shown in the following numerical formula (101):

$$0.80 \leq \frac{H1}{H2} \leq 2.33. \quad (101)$$

2. The molding facility according to claim 1, wherein the core height H1 of the electromagnetic stirring device and the core height H2 of the electromagnetic brake device satisfy the relationship shown in the following numerical formula (103):

$$1.00 \leq \frac{H1}{H2} \leq 2.00. \quad (103)$$

3. The molding facility according to claim 2, wherein a casting speed is 2.2 m/min or less.

4. The molding facility according to claim 1, wherein the core height H1 of the electromagnetic stirring device and the core height H2 of the electromagnetic brake device satisfy the relationship shown in the following numerical formula (105):

$$1.00 \leq \frac{H1}{H2} \leq 1.5. \quad (105)$$

5. The molding facility according to claim 4, wherein a casting speed is 2.4 m/min or less.

6. The molding facility according to claim 1, wherein the core height H1 of the electromagnetic stirring device and the core height H2 of the electromagnetic brake device satisfy the relationship shown in the following numerical formula (2):

$$H1+H2 \leq 500 \text{ mm} \quad (2).$$

7. The molding facility according to claim 1, wherein the electromagnetic brake device is comprised of a split brake.

8. The molding facility according to claim 1, wherein a casting speed is 2.0 m/min or less.

* * * * *